US005596554A

United States Patent [19]

Hagadorn

[11] Patent Number: 5,596,554

[45] Date of Patent: Jan. 21, 1997

[54] SET OPERATION IN A TIMEPIECE HAVING AN ELECTROOPTICAL DISPLAY

[76] Inventor: Hubert W. Hagadorn, 9 Light Way, Menlo Park, Calif. 94025

[21] Appl. No.: 72,136

[22] Filed: Jun. 4, 1993

[51] Int. Cl.[6] ..... G04C 19/00; G04C 9/00; G09G 3/04

[52] U.S. Cl. ..... 368/82; 368/186; 368/200; 368/239; 345/34; 345/98

[58] Field of Search ..... 368/10, 69–72, 368/82, 185–187, 239; 340/33, 34, 50, 53, 56, 87, 90, 94, 98–100, 121, 141

[56] References Cited

U.S. PATENT DOCUMENTS

| | | | |
|---|---|---|---|
| Re. 31,225 | 5/1983 | Willis et al. | 368/70 |
| 3,744,049 | 7/1973 | Luce | 340/336 |
| 3,810,355 | 5/1974 | Ito | 58/23 A |
| 3,823,545 | 7/1974 | Vittoz et al. | 58/23 R |
| 3,846,784 | 11/1974 | Sinclair | 340/336 |
| 3,925,775 | 12/1975 | Gay | 340/324 |
| 3,925,777 | 12/1975 | Clark | 340/336 |
| 4,004,407 | 1/1977 | Fujita | 368/201 |
| 4,185,283 | 11/1980 | Clark | 340/802 |
| 4,254,494 | 3/1981 | Maeda | 368/187 |
| 4,303,996 | 12/1981 | Schmitz | 368/82 |
| 4,354,269 | 10/1982 | Planzo | 368/10 |
| 4,444,515 | 4/1984 | Clark | 368/279 |
| 4,472,066 | 9/1984 | Murakami | 368/82 |
| 4,502,790 | 3/1985 | Yokoyama | 368/200 |
| 4,708,491 | 11/1987 | Luitje | 368/156 |
| 4,903,251 | 2/1990 | Chapman | 368/156 |
| 4,953,149 | 8/1990 | Marvosh | 368/223 |
| 4,956,826 | 9/1990 | Coyman et al. | 368/28 |
| 5,140,563 | 10/1992 | Thinesen | 368/69.7 |
| 5,220,291 | 6/1993 | Hagadorn . | |

OTHER PUBLICATIONS

"Real–Time Clock Plus RAM (RTO," Motorola Integrated Circuit, MC146818A, Microprocessor, Microcontroller and Peripheral Data, vol. II, Motorola, pp. 3–1673 to 1691.

"COP620C . . . /COP8206 . . . /COP842 Single–Chip micro CMOS Microcontrollers," National Semiconductor, Microcontroller Databook, 1989, pp. 2–7 to 2–26.

"Designing an LCD Dot Matrix Display," B. Lutz, National Semiconductor Application Note 350, 1984.

"Test Circuit for LCD–Demo (2–Way Mux) with COP 8206," Memorandum by S.R., National Semiconductor, 1987.

"Liquid crystal displays . . . principles and applications", Philips Export B. V., Technical publication 260, 1988.

"Multiplexed Liquid Crystal Display—Theoretical Considerations," LXD Application Note–05, Liquid Xtal Displays Inc., Cleveland, Ohio.

"Novel Clock Displays Hours and Minutes One Digit at a Time," Electronic Design News, Jul. 20, 1973, pp. 25–26.

"Build the Monodigichron," Popular Electronics, Sep., 1973, M. Robbins, pp. 35–39.

*Primary Examiner*—Vit W. Miska

[57] ABSTRACT

A manual set operation is described for a timepiece where a single switch is used to select categories and values for setting timekeeping quantities. The timepiece is implemented using a CMOS microcontroller integrated circuit and employs a matrix liquid crystal display to display time and calendar information one character at a time, in a slide-show manner.

19 Claims, 10 Drawing Sheets

CLOCK OPERATION

DISPLAY AND TIMEKEEPING SUBROUTINE

SET MODE OPERATION

CONTINUATION OF FIG. 4A

SWITCH ON-OFF BLOCK

DAYLIGHT SAVINGS TIME ROUTINE

DAYLIGHT SAVINGS TIME SUBROUTINE "MATCH"

LCD DRIVER

170

BACKPLANE WAVEFORM GENERATOR

BACKPLANE RELATED WAVEFORMS

SET OPERATION IN A TIMEPIECE HAVING AN ELECTROOPTICAL DISPLAY

BACKGROUND

1. Field of Invention

This invention relates to digital electronic clocks having electrooptical displays, and more specifically to the setting and display of information, implementation of clock functions, and design of low power circuitry for LCD drive.

BACKGROUND

2. Description of Prior Art

In the 1973–1974 period a few novel electrooptical displays were developed that used a single seven segment readout. The readout segments were individually selectable and driven in combination to display the digits zero through nine. Multidigit data was displayed by sequentially displaying one digit at-a-time, in order from most to least significant digit. Interest in such displays was evidently inspired by the frequent use of segmented LED displays in small hand held calculators and digital clocks. Readouts of one half inch or so were often used for digital clocks owing to the greater viewing distances desired. These larger readouts were expensive and required one readout for each digit. A single digit display could be produced at lower cost owing to a single readout, a reduced number of segment drivers, and reduced power consumption. For a given display size or cost the digits could be larger making them more readable, and or readable at greater distances. Sinclair (U.S. Pat. No. 3,846,784) describes the display of an electronic calculator result having a seven segment readout mounted at the end of a swinging pendulum. The digits are displayed at fixed positions on an arc of the pendulum swing so that a multidigit number is seen owing to persistence of vision effects. Its use as a clock was not mentioned although its manner of operation is nevertheless quite suggestive. The readout of the sequential display character clock described in the preferred embodiment, however, is stationary and no visual persistence effects are relied on.

Robbins in an article "Build the Monodigichron," Popular Electronics, September 1973, pages 35–39, describes a digital clock using a single seven segment readout and electronic timekeeping circuitry utilizing National Semiconductor's MM5314 clock integrated circuit. The time in hours and minutes is presented as a sequence of digits, one-at-a-time, and at about a one per second rate. Gay (U.S. Pat. No. 3,925,775) describes a similar display where digits are presented in serial fashion at rates of about two to four digits per second. Data at these faster rates was reported to be easily assimilated provided the number of digits is not excessive. A National Semiconductor MM5313 clock integrated circuit was used for basic timekeeping purposes. Clark (U.S. Pat. No. 3,925,777) describes a single digit clock that displays data much as Gay described, but at a one digit per second display rate. A similar integrated clock circuit was employed, a National Semiconductor MM5311. Robbins, Gay, and Clark constructed sequential digit clocks using standard integrated clock circuits and by means of additional circuitry gated digital clock signals so as to display time on a single readout one digit at-a-time. In all instances digits were presented at a constant rate and in a simple repeating manner.

Single digit, or more generally single character displays, although limited to the display of a single digit or character are not limited to the quantity of information that can be displayed. Certainly, a more interesting display results if horological information such as hours and minutes is not displayed in simple repetition as has been previously demonstrated but also includes calendar data, such as the day of the week, the month and the day of the month. Greater interest can be given to the display by not displaying all information at the same frequency. This latter fact is used to advantage in that horological data is displayed more frequently than calendar information so as not to materially compromise the clock's basic function as a timepiece.

The power sources for the prior art single digit clocks were externally supplied by the AC line. Battery operation for these clocks would require a considerable number of standard 1.5 V cells in order to supply voltages of at least 11 volts and currents on the order of milliamperes. The MOS (metal-oxide semiconductor) clock integrated circuits have largely given way to lower power CMOS (complementary MOS) circuits. This and the availability of substantially lower power LCD's (liquid crystal displays) has resulted in a variety of battery operated electrooptical clocks in use today. Generally, battery supply currents are less than 100 microamperes and one or two standard 1.5 V AA or AAA size cells are sufficient for at least one year's operation.

In the preferred embodiment described for this invention horological and calendar information are sequentially displayed one character at-a-time. Effort was directed towards obtaining suitably low operating supply currents for reasons of achieving one or more years of life from a pair of AA or AAA size cells, this being done while using commercially available components. A National Semiconductor microcontroller was selected to perform basic clock functions based on considerations of supply voltage operating range, 2.5–6 V—which is suitable for operation from a series connected pair of 1.5 V cells, a supply operating current of about seven microamperes for a microcontroller reference frequency of about 32,768 hz, ROM memory (read only memory, 1024 bytes), RAM memory (random access memory, 64 bytes), and a development system supported in the U.S.A. The COP820C microcontroller ROM is mask programmable and is consequently available only in large quantities. Microcontroller supply current estimates are based on a COP820C microcontroller supplied by National Semiconductor, programmed with code unrelated to this invention, and operating at a reference frequency of 32,768 hz. The development effort included design of a low voltage 32,766 hz crystal oscillator having an operating supply current of about three microamperes (U.S. patent application Ser. No. 854,251 for "Complementary Transistor Oscillator"), and the development of low power LCD multiplex drive circuitry, specifically referred to as 2:1 or duplex drive, one-half bias, having an operating voltage range of 2.5–3.2 V, and a supply current of about one microampere. The total clock supply current is expected to be about twelve microamperes. Basic signals for multiplex drive were generated by means of a programmed instruction loop in which drive signal level changes occur at fixed increments of processor cycles in order to obtain DC free voltages across direct coupled LCD elements and thereby achieve maximum LCD contrast.

A memorandum received from National Semiconductor, "Test Circuit for LCD-Demo (2-Way Mux) with COP 820C", describes a COP820C microcontroller programmed to implement a multidigit clock evidently for purposes of demonstrating the microcontroller's capability and low power consumption. An LCD was driven using duplex multiplex drive with waveforms being generated on the basis of a programmed instruction sequence similarly as mentioned in the above paragraph. There are, however, significant differences. The reference frequency for the demo clock is one megahertz compared to 32,766 hz for the sequential display calendar clock described herein, thus requiring a considerably greater microcontroller supply operating current, and presenting a much less problem in executing instruction code for both timekeeping operations and the generation of multiplex waveforms. In the demo clock resistors were employed for generating intermediate voltage levels for backplane waveforms, this however requiring an additional supply current of about 65 microamperes. The demo clock supply current is estimated to be about 350 microamps, assuming a nominal supply voltage of 2.8 V.

The relatively low microcontroller reference frequency employed for the sequential display calendar clock required that special attention be given to conserving the number of instruction cycles needed to load output ports with multiplex waveform data as the fundamental multiplex frequency should be at least 30 hz to avoid display flicker (Philips Technical Publication 260, page 6). Multiplex waveform generation was facilitated by a table look up procedure in RAM (as well as in ROM), a blanking interval, and additional semiconductor circuitry.

An important concern for a clock is how to set it. A single readout clock presents some unique difficulties. Robbins and Gay both describe the use of switches for setting; however, there is no visual feedback in making selections so that a trial and error process exists. Clark does not discuss setting for his clock (U.S. Pat. No. 3,925,777) although he does in another patent for a erring watch (U.S. Pat. No. 4,444,515). Here time is presented in a format of coded characters that the wearer can recognize. Setting is performed by simultaneously closing two set switches to reset timekeeping counters, then the hour switch is depressed a number of times corresponding to the desired number of hours, and similarly for the minute switch. This eliminates the trial and error setting process but numerous switch actions are often required. The hours and minutes cannot be independently set as both must first be reset. Furthermore, additional switches would be needed to set additional quantities. This approach while acceptable for a novel erring watch is less desirable for a timepiece where multiple functions must be set. The demo clock mentioned above apparently was set by means of a reset switch to the microcontroller. As a result setting would be limited to a fixed time such as 12:00.

In the preferred embodiment of this invention a single switch is used for setting purposes. Vittoz et al. (U.S. Pat. No. 3,823,545) describe the use of a single switch to select a digit for setting purposes from a sequence of numbers appearing on a matrix display. However, a second switch (at least) was necessary to transfer a given digit (tens of hours, unit hours, tens of minutes, or unit minutes) to an appropriate register. Moreover, an additional display was used to indicate the time quantity being changed. Willis et al (Re. 31,225) describe the use of a single switch to select time quantities such as hours, minutes, and date by means of indicia, e.g. by flashing the respective time quantity, but such an approach was applied only to changes in displayed time quantities (there were apparently no undisplayed time quantities). The set counts for seconds, minutes, hours, and days could equal their maximum values and hence a corresponding number of seconds. No count speed-up option was demonstrated. Also, an exit to normal display mode occurs for each setting which further serves to increase setting time. These objections are overcome in the present invention.

A previously undisclosed time recognition problem can occur that is peculiar to the display of time on a digit-by-digit basis for a single character clock. It is that the time will be erroneous perceived unless the display of the digits is properly synchronized to when time changes occur. For instance, if a carry occurs just before or during the display of a digit, then the next higher significant digit changes, which is not recognized by the viewer. Consider the display of hours and minutes when the time is 12:29. Assuming the digits and colon are displayed at one second intervals with a delimiting space between repetitions, a possible displayed sequence will be 12:29 12:29 12:20 12:30. Here the time 12:20 is perceived when it is actually 12:30. This results when the unit minutes digit advances to zero just prior to it is displayed, and the next higher significant digit is incremented by one, which is not displayed. Numerous such errors can occur. If the unit minutes carry occurs during a space interval then no errors will occur. Synchronization for the above sequence is indeed possible in that the repetition interval (6) is evenly divisible into the number of intervals for a change in the unit minutes digit (60). If these numbers are mutually prime then no synchronization is possible as all digit positions will be displayed upon a carry from the unit minutes digit. However, data changes for the preferred embodiment of this invention do not depend on prime number considerations as synchronization is achieved by displaying a variable number of periods before the onset of a new minute.

The preferred embodiment of this invention also includes a user speed adjustment. Despite a relatively stable crystal oscillator for a frequency reference, the oscillator frequency will vary owing to manufacturing crystal tolerance considerations, and additionally, to frequency errors arising from crystal temperature and aging effects. By including a user speed adjustment the user may make a correction for such errors.

Two patents have been issued concerning adjustment of the oscillator frequency, one by Luitje (U.S. Pat. No. 4,708,491) and another by Chapman (U.S. Pat. No. 4,903,251). In both cases a microcontroller is employed. A division of the oscillator frequency in both instances is adjusted to achieve a slight frequency correction for initial crystal oscillator frequency errors. Correction frequency data during production is obtained in either case and related data is stored in EEPROM (electrically erasable programmable read only memory) for subsequent use. There is no user ability to modify the frequency correction. Additionally, there are a number of differences in how time corrections are made including the operation of the timer, the interval in which corrections are applied, and the non-use of interrupts.

The following information is given for those that might not be familiar with LCD's and their method of drive. The basis for LCD operation is a rotation of polarized incident light in a liquid crystal medium, the degree of rotation being affected by an impressed electric field within the medium. The liquid crystal fluid is contained between front and back glass plates. Polarizers are aligned and attached to the outside faces of the two glass plates, and for a reflective display a reflective material is attached to the polarizer of the back glass plate. A display element has transparent conductive electrodes deposited on the inner sides of both glass plates, the overlapping portion of these elements corresponding to the perceived element shape. The wiring of the elements in a display depends on the type of drive it is designed for. A display element will appear dark or light according to a RMS voltage across its electrodes being above or below prescribed threshold voltages. In the LCD of the preferred embodiment a reflective type display is used, and a high RMS voltage results in a darkened element.

LCD's drives are necessarily AC as DC voltages result in electro-chemical effects that reduce LCD life ("Liquid crystal displays . . . principles and applications, "Philips Export B. V., Technical publication 260, 1988). Drives are either direct or multiplex. In direct drive the elements on one plate are individually driven while the facing elements on the other plate are commonly driven, the elements having a common connection. Direct drive thus requires more connections and drivers than multiplex drive although the drivers are often simpler in that only two drive levels are required, the levels often corresponding to logic levels.

In multiplex drive the electrodes are connected in an n by m arrangement, where n and m are the number of frontplane and backplane connections, respectively. For duplex multiplex drive, and a thirty element display—which is described in the preferred embodiment, n and m are respectively fifteen and two. Hence seventeen connections are required, compared to thirty-one for direct drive.

In direct drive both frontplane and backplane waveforms have two voltage levels and are squarewaves. When a frontplane signal is in phase with the backplane signal then minimal RMS voltage exists across an LCD element and it appears light, for instance. Conversely, if the frontplane signal is out of phase with the backplane signal then maximum RMS voltage exists and an element appears dark.

In duplex multiplex drive frontplane signals similarly have two voltage levels and are squarewaves. The phase of the frontplane signals is similarly employed to impress high or low RMS voltages across display elements. The backplane waveform signals are stepped waveforms having three amplitude levels, a third level being midway between the other two levels. The frontplane signals have one of four possible phases with each phase determining one of four light-dark states for two elements. Two references for LCD information are, "Multiplexed Liquid Crystal Displays—Theoretical Considerations," LXD Application Note- 05, Liquid Xtal Displays Inc., Cleveland, Ohio; and, "Designing an LCD Dot Matrix Display," B. Lutz, National Semiconductor Application Note 350, 1984. Additional LCD information is available from LCD and LCD driver manufacturers.

SUMMARY OF THE INVENTION

A sequential display calendar clock is described in which a general purpose microcontroller (COP820C, National Semiconductor) is programmed to perform timekeeping, display, LCD multiplex drive, and using but a single switch-setting functions. A low power crystal oscillator operating at 32,766 hz provides a stable reference frequency for the microcontroller. Additional circuitry including standard off-the-shelf high-speed CMOS logic gates and four analog switches convert microcontroller output signals to frontplane and backplane multiplex drive signals for driving a thirty element LCD matrix display.

The sequential display character clock displays horological and calendar information sequentially one character at-a-time at a one second rate and in a slide-show fashion. Displayed is the time in minutes and hours, and less frequently the day of the week, the day of the month, the month, and day of the year.

The microcontroller spends 92% of a one second interval generating multiplex drive signals. The remaining 8% of an interval is a blanking interval in which multiplex drive signals are latched to logic low levels and the display is thereby blank. It is during this small interval that timekeeping takes place, the next character is determined for display, the character's appearance information is obtained from ROM, and appropriate multiplex waveform data is stored in RAM. The RAM data enables a display subroutine to rapidly generate precisely timed multiplex drive and or related timing signals at microcontroller output ports as needed for DC free multiplex drive, and at a frequency sufficient to avoid display flicker (30 hz) despite a relatively low microcontroller reference frequency.

The 8% blanking interval serves another purpose in that it allows differentiation of consecutive identical characters (otherwise for instance, the time 11:00 o'clock might be mistaken for 1:00 o'clock). This short interval appears to be quite acceptable, shorter intervals make differentiation less obvious while larger intervals were found to produce an undesirable flashing effect.

Once each minute a full one second blanking interval occurs for extended timekeeping purposes. It is during this time that minutes are updated, and as need be the hours, the day of the month, the day of week, and other fundamental time units.

Essential to the operation of the microcontroller as a clock is a decrementing timer internal to the microcontroller that operates in parallel with the processor's execution of instruction code. The timer automatically decrements at the instruction cycle rate, with programmed instructions enabling the timer to keep track of time intervals of one second and less. A timer underflow bit is set in a status register upon a timer underflow. A portion of each blanking interval is devoted to a program loop in which the timer underflow bit is repeatedly examined until it is set, therein determining a one second interval (or nearly so). A periodic correction is applied to the cycle counting process once each minute to obtain minute intervals of greater precision and also to permit minor user speed corrections.

Upon power-up or on depressing the set switch a set mode is entered. A menu is presented as a sequence of items, each item corresponding to a function or action to be taken, and each item represented by a character. A selection is made by depressing the switch when the representative character is displayed. Each selection results in that quantity or an equivalent quantity being stored in RAM. Except for selection of R, which allows entry to normal operating mode, a second menu is presented which gives the options of examining or changing item values, or returning to the display of the first or main menu. If a value is to be examined then that value is presented sequentially character by character, similarly as for normal operation. If a value is to be changed, then the leftmost character (as might be viewed on a written page) will be changed first. A set of possible characters for selection is displayed one-at-a-time, and a character is selected as above by depressing the switch when the character is displayed. The next character to be changed is then automatically referenced and another set of character choices is displayed, with a similar selection taking place. When possible the selectable values are limited based on previously entered information. The selections are stored in RAM, and finally a second menu is again displayed whereupon the main menu may be selected for display. Upon display of the main menu, another item may be selected for change or examination, and a similar selection process occurs. Finally, after all desired items are set, R is selected from the main menu for entry to normal timekeeping operation.

A feature of the switch operation is that a character may be continuously displayed by simply keeping the switch depressed. This is useful for a visual confirmation of the selected character.

Other features of this clock include a 12/24 hour display option, a user ability to make digital speed corrections, and a user option to enable automatic DST corrections including setting of the starting or ending DST Sunday. Thus DST may be set for countries having different DST dates than our own, or for different dates in this country should DST dates change, as has occurred many times in the past.

The day of the week is determined automatically for any date after Oct. 15, 1582 when the change from the Julian to Gregorian calendar took effect (losing 10 days). Thus the day of the week is determined from the date inclusive of year information. To obtain the day of the week correctly over centuries the four hundred year leap year cycle algorithm is implemented, i.e. leap years occur in any year evenly divisible by four except for centenary years not evenly divisible by four hundred.

The beginning of each minute starts with the display of the most significant hour digit. Just before the one second blanking interval, when an additional quantity of information cannot be completely displayed—such as the day of the month, a sequence of one or more periods is introduced. The number of periods varies as the number of data digits varies depending on the number of significant digits in the data (digit positions are not padded with leading zeros or spaces). These periods serve to synchronize the display to when one minute changes occur so that perception errors, as previously described, do not result, that is—there are no unperceived changes in previously displayed digits of greater significance.

A feature is also provided in that the beginning of a new minute is discerned upon the display of the first hour digit following the display of one or more periods. Hence, the seconds past the minute may be reckoned on counting characters following the initial display of the most significant hour digit (two consecutive blank characters do not occur). Another feature enables time to be set to an accuracy of about one second by an appropriately timed release of the set switch.

OBJECTS AND ADVANTAGES

Objects and advantages of the invention and its ramifications include:

To provide the consumer with a novel sequential display calendar clock.

To present a multitude of information in a not so repetitive format using numeric and alphabetic characters for greater user comprehension and interest, yet while displaying the time of day most frequently to preserve the clock's main function as a timepiece.

To provide in a sequential display character clock a relatively simple means for the distinction of when minute changes occur, and for setting time to within two seconds.

To design a sequential display calendar clock from commercially available components, and to operate the clock from a pair of AAA size batteries for at least one year.

To provide a digital clock having a relatively large character display area that may be of assistance to the sight impaired.

To display information in a timepiece, not all of which can be displayed at once, and without user intervention.

To provide a user digital speed adjustment in an electrooptical apparatus keeping time.

To implement timekeeping including a digital speed adjustment feature and other functions in a general purpose microcontroller without the necessity of processing interrupts, in order to conserve memory by not requiring instruction code for servicing interrupts, and to further safeguard timekeeping and other operations.

To provide for automatic DST hour corrections, and user selectable DST Sundays in an electrooptical apparatus keeping time.

To implement the four hundred leap year algorithm in an electrooptical apparatus keeping time, and thereby to provide an automatic day of the week determination from the entered date for an indefinite time period.

To simply and readily select and set information in an electrooptical apparatus using a series of menus having selectable items and a single pushbutton switch.

To construct an LCD multiplex driver from currently available electronic components, having an operating voltage range from 2.5 V to 3.2 V, and requiring a supply current of less than five microamperes.

Additional objects and advantages will be apparent from the description for the preferred embodiment, accompanying drawings, and following ramifications.

DETAILED DESCRIPTION OF A PREFERRED EMBODIMENT

Figure 1:
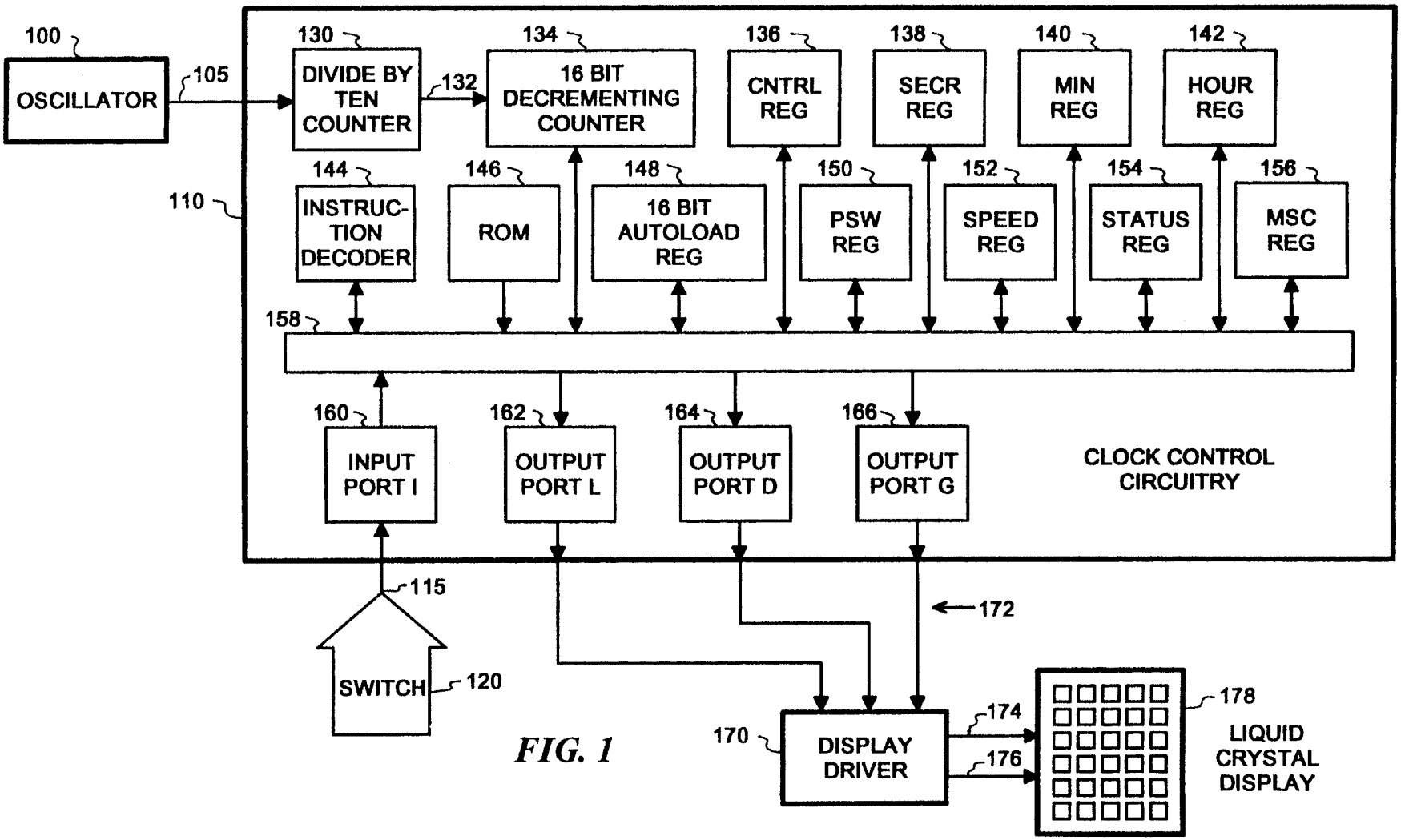
FIG. 1 shows the microcontroller clock circuitry and other principal clock components.

The principal electronic components of a preferred embodiment for the sequential display calendar clock are shown in FIG. 1. A microcontroller integrated circuit, COP 820C 110, manufactured by National Semiconductor, is programmed to perform functions of timekeeping, sequencing of display information, setting, and generation of LCD timing/drive signals 172. A 32,766 hz crystal controlled oscillator 100 generates a squarewave reference frequency at input 105 for microcontroller 110 timing purposes.

A single SPST (single pole single throw) pushbutton switch 120 is used for setting the clock. Switch 120 is input to microcontroller input port I 160 at input terminal 115.

LCD timing/drive signals 172 originate from microcontroller output ports L 162, D 164, and G 166, and are received by display driver 170. The display driver 170 generates LCD frontplane 174 and backplane 176 signals that drive a 30 element LCD matrix display 178. Although not apparent from this figure, some microcontroller signals 172 actually directly drive LCD 178, as some direct input-output connections exist within LCD driver 170. This will be further discussed when describing FIG. 7A.

The COP 820 C microcontroller 110 features static CMOS construction for low current consumption (10 microamps maximum for halt mode), 1024 bytes of mask programmable ROM (.read only memory) 146, and 64 bytes of internal RAM (random access memory) 138, 140, 142, 152, 154, 156. The microcontroller includes a 16 bit timer/counter 134 and 16 bit autoload register 148 which are configured to operate together as a recycling or modulo timer to achieve frequency division of the reference frequency. An instruction decoder 144 interprets and executes instruction code, a control register CNTRL 136 determines the configuration of decrementing counter 134 and autoload register 136, and a processor status register PSW 150 enables interrupts to be set or disabled (they are disabled), with one of its bits also indicating a timer underflow condition. A common bus 158 interconnects decrementing counter 134, registers 136, 138,140, 142, 148, 150, 152, 154, and instruction decoder 144 bidirectionally. Additionally, ROM 146 and input port I send data to bus 158, while output ports L 162, D 164, and G 166 receive data from bus 158. Details on the construction and performance of the COP820C microcontroller may be found in National Semiconductor's Microcontroller Databook, 1989, pp 2-7 to 2-26.

Oscillator 100 is a stable 32,766 hz quartz crystal oscillator employing a standard 32,768 hz watch crystal. As previously mentioned this oscillator is described in patent application Ser. No. 854251. The 32,768 hz crystal is often used in battery operated timepieces as its relatively low frequency yields acceptably low switching losses with DC supply currents on the order of microamperes being achievable. The 32,768 hz frequency is convenient in that a one hertz frequency is obtainable by fifteen binary division stages. Oscillator 100 differs slightly from that particularly described in the patent application in that a so-called pull-up capacitor has been deleted. Quite often this capacitor is absent in crystal oscillator circuits and the effect of its deletion here is to reduce the oscillator frequency by about two hertz. This frequency error is of little concern as the modulus value for timer 134–148 is programmable, and thus, as will be shown, the error is of no consequence.

Counter 130 receives the oscillator output at input 105 and produces a frequency one-tenth the oscillator frequency at output 132. This latter frequency is the instruction cycle rate of instruction decoder 144, and the rate at which 16 bit counter 134 is decremented. Decrementing counter 134 is automatically preloaded upon its underflow by autoload register 148, at which time an underflow status bit is set in PSW register 150. Nominal preload data for autoload register 148 is obtained from data in ROM 146 with a minor correction applied once each minute from user supplied data in RAM, namely SPEED register 152. The correction is applied once a minute and hence increases the precision of one minute and longer time intervals. This is further discussed when describing FIG. 3.

The SECR 138, MIN 140, HOUR 142, SPEED 152, and STATUS 154 registers are general purpose registers in RAM so named because of the programmed functions they perform. A direct count of the seconds past the minute is not stored but rather a count of the seconds remaining in a one minute interval, this being preferred as program instructions favor decrementing. The count is stored in SECR register 138 (seconds remaining). Upon 60 decrements the minute register MIN 140 is updated and as required other registers such as HOUR 142, and day of week (DOW), the latter being amongst the RAM registers MSC 156.

On power-up various program initializations occur such as specifying ports as inputs or outputs, setting the timer operating mode, specifying the location of the stack pointer (for subroutine return purposes), starting the timer, etc. Information for these initializations may be found in the cited microcontroller databook. Certain programmed initializations are also performed such as the clearing of RAM registers, and the transfer of dam from ROM to RAM to establish an initial operating state on power-up. One who is skilled in the art will recognize that specific details of the these initializations can vary and are not essential in describing the fundamental operation of the microcontroller, or of this clock.

Figure 2:
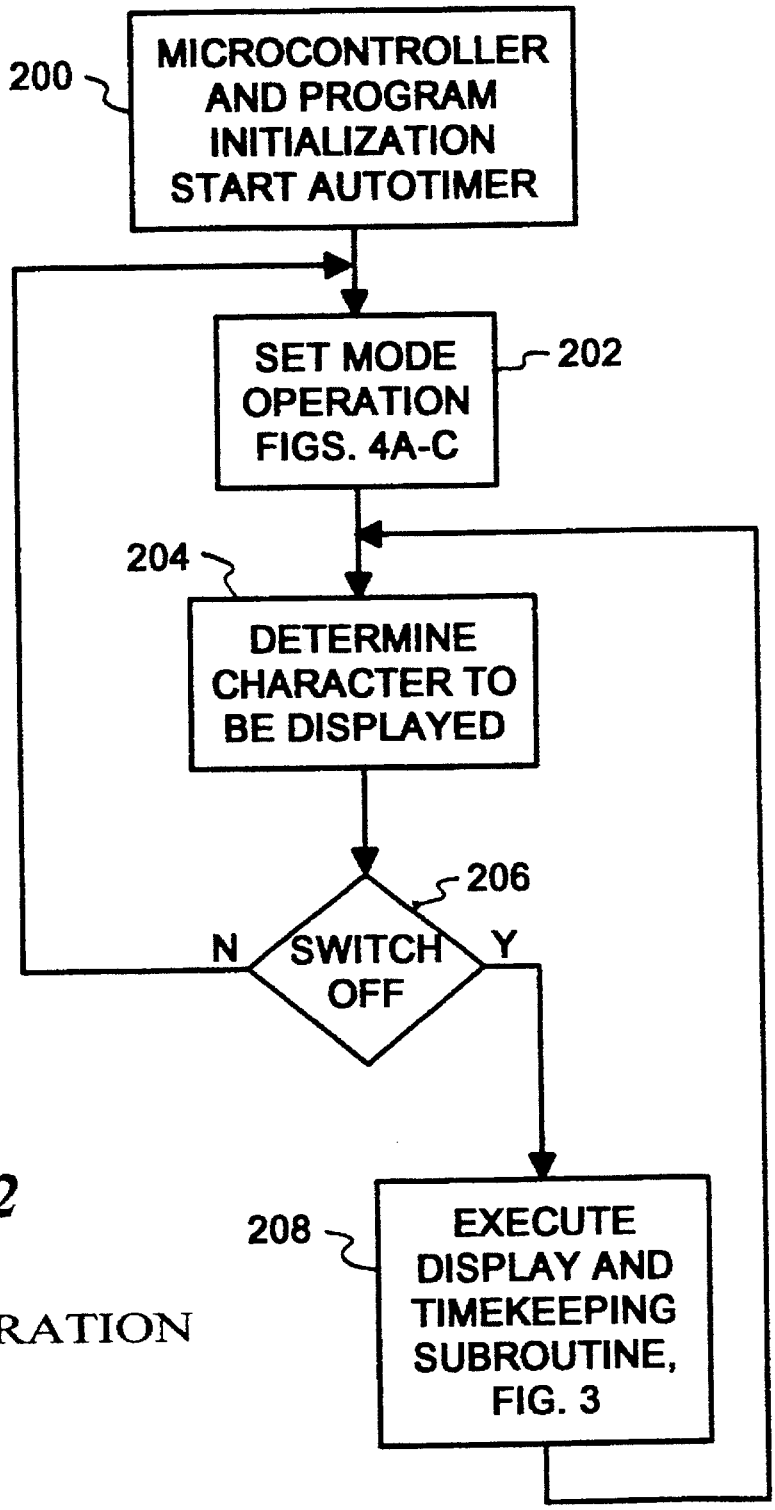
FIG. 2 is a flowchart of the basic clock operation.

In FIG. 2 an overview of the clock operation is given. Upon insertion of batteries microcontroller 110 is initialized as discussed in the above paragraph. Subsequently set mode operation 202 begins, and will be discussed in some detail when describing the flowcharts of FIGS. 4A–4C. Next, the first character in a basic two minute sequence (120 characters including blanks) is determined for display 204.

As long as switch 120 is off decision 206 enables the selected character to be displayed and timekeeping to occur 208. This is further discussed when describing the flowchart of FIG. 3, Display and Timekeeping Subroutine. Next, a determination is made of the second character to be displayed 204 and if switch 120 is off the second character is displayed 208. This process continues with the display of characters in a sequential slide-show manner at a one second rate, and in an order as they would appear in written material. The execution of this loop constitutes normal timekeeping operation. A portion of the Display and Timekeeping Subroutine 208, Display Subroutine Code, Table 3, generates multiplex drive/timing signals for displaying characters, this execution time being 0.92 second for each character. The remaining instructions in the loop take 0.08 second, and during this time the display is blanked, that is the LCD drive signals 174 and 176 are latched at low logic levels (near ground potential) thereby enabling execution of instructions external to the Display Subroutine. The time for the one second loop is regulated by a minor loop (FIG. 3, 352) which checks for a timer underflow condition.

Once each minute and just before a new minute display blanking occurs for an entire one second interval to allow time for more extensive timekeeping purposes such as updating minutes MIN 140, hours HOUR 142, and longer time units amongst registers MSC 156.

If set mode operation is desired then switch 120 is depressed, it is then on, and thus decision 206 transfers instruction processing to Set Mode Operation 202.

Below, the display for a representative two minute interval is given. The first and second lines indicate tens and units of seconds corresponding to when each character is displayed, respectively. It may be noted that the time is given most often, the day of the week and the day of the month less often, and the month and day of the year least often.

```
000000 0 000111111111 1 12222222222 3333333333 4 44444444445 5 55555555
012345 6 789012345678 9 012345678 9 0123456789 0 1234567890 1 23456789
5: 14 MR 19.  5: 14 TH 19 5: 14 TH 19 5: 14 TH 19 5: 14 TH 19 5: 14 TH 19....
5: 15 DA 79.  5: 15 TH 19 5: 15 TH 19 5: 15 TH 19 5: 15 TH 19 5: 15 TH 19....
```

Leading zeros are not displayed except for tens of seconds or zero hours when operating in a 24 hour mode. Periods are displayed to denote one second intervals when another hour and minute, or day of week and day of month cannot entirely be displayed before the minute changes. This synchronizes the display to when one minute changes occur and adverts aforementioned perceived errors in time varying multidigit numbers due to unrecognized changes in higher order digits (owing to propagation of carries). The periods also indicate the onset of a new minute. A minor feature is provided in that the seconds past the minute may be noted on counting the characters displayed beginning with the first digit displayed for a new minute, this being aided by the fact that two consecutive space characters do not occur.

Figure 3:
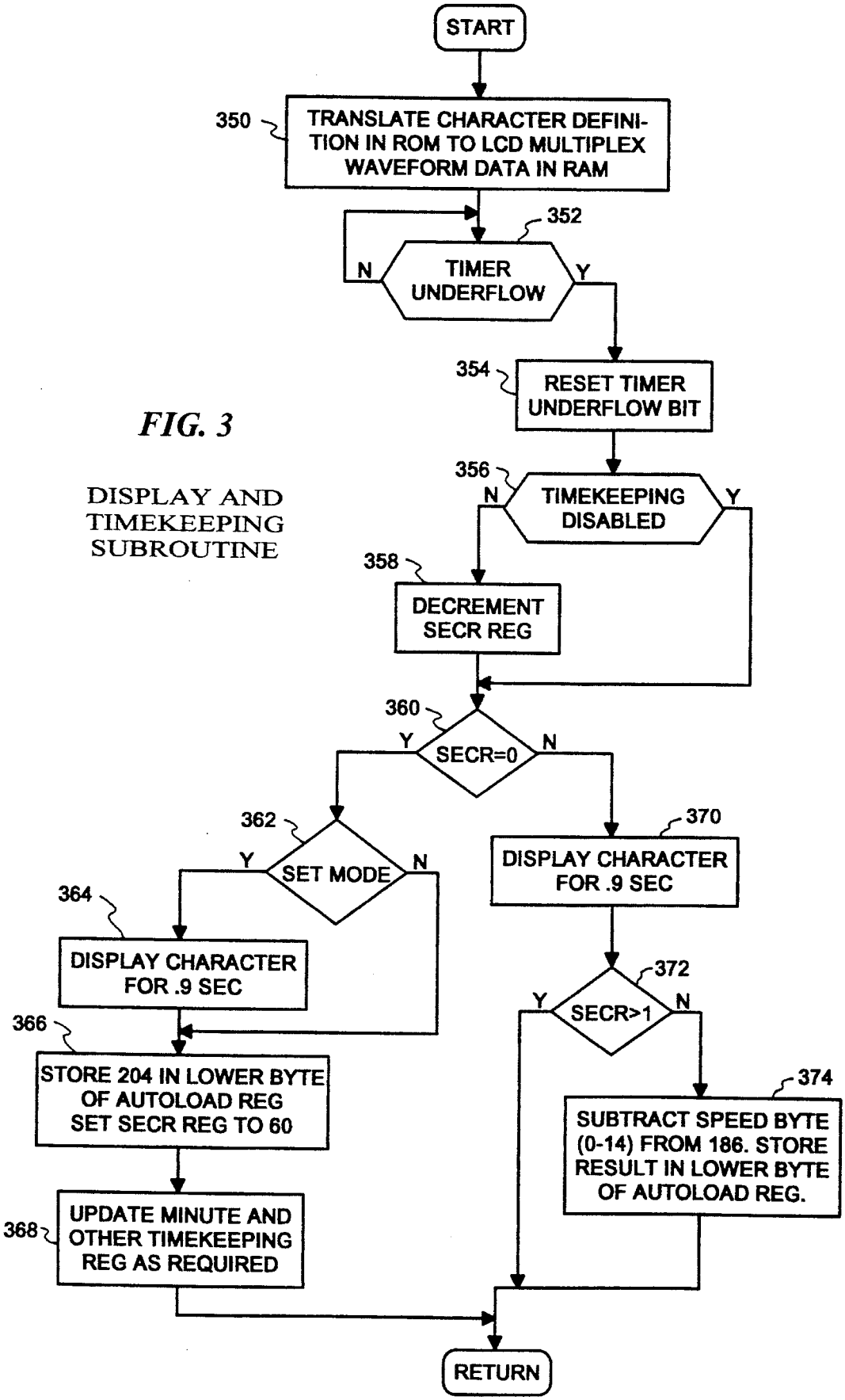
FIG. 3 is a flowchart of the Display and Timekeeping Subroutine.

A flowchart of the Display and Timekeeping Subroutine is given in FIG. 3. A character's appearance is defined by 30 ROM bits in a one-to-one relationship to the on-off condition of 30 LCD elements 178. These bits are stored in four consecutive bytes in ROM 146 (containing eight bits each). Two bits are set to one and serve to facilitate clocking output port data in latches, this being discussed in greater detail when describing FIG. 7A.

The Display and Timekeeping Subroutine is executed during both normal and set operation modes. Four bytes are read from ROM 146 and are converted to twelve bytes of multiplex waveform data in RAM (MSC registers 156) 350. This data is in a form that allows the Display Subroutine to rapidly transfer data to microcontroller output ports G, D, and L, in a sequential and precisely timed manner for the generation of multiplex waveforms, and at a sufficiently high rate so as to avoid display flicker (at 120 hz, yielding a 30 hz fundamental backplane waveform frequency).

Following generation of the multiplex waveform data, a wait loop exists 352 until a timer underflow occurs, this underflow being detected by repeatedly examining for a set condition of a timer underflow bit stored in PSW register 150. The bit is then reset 354.

Figure 4A:
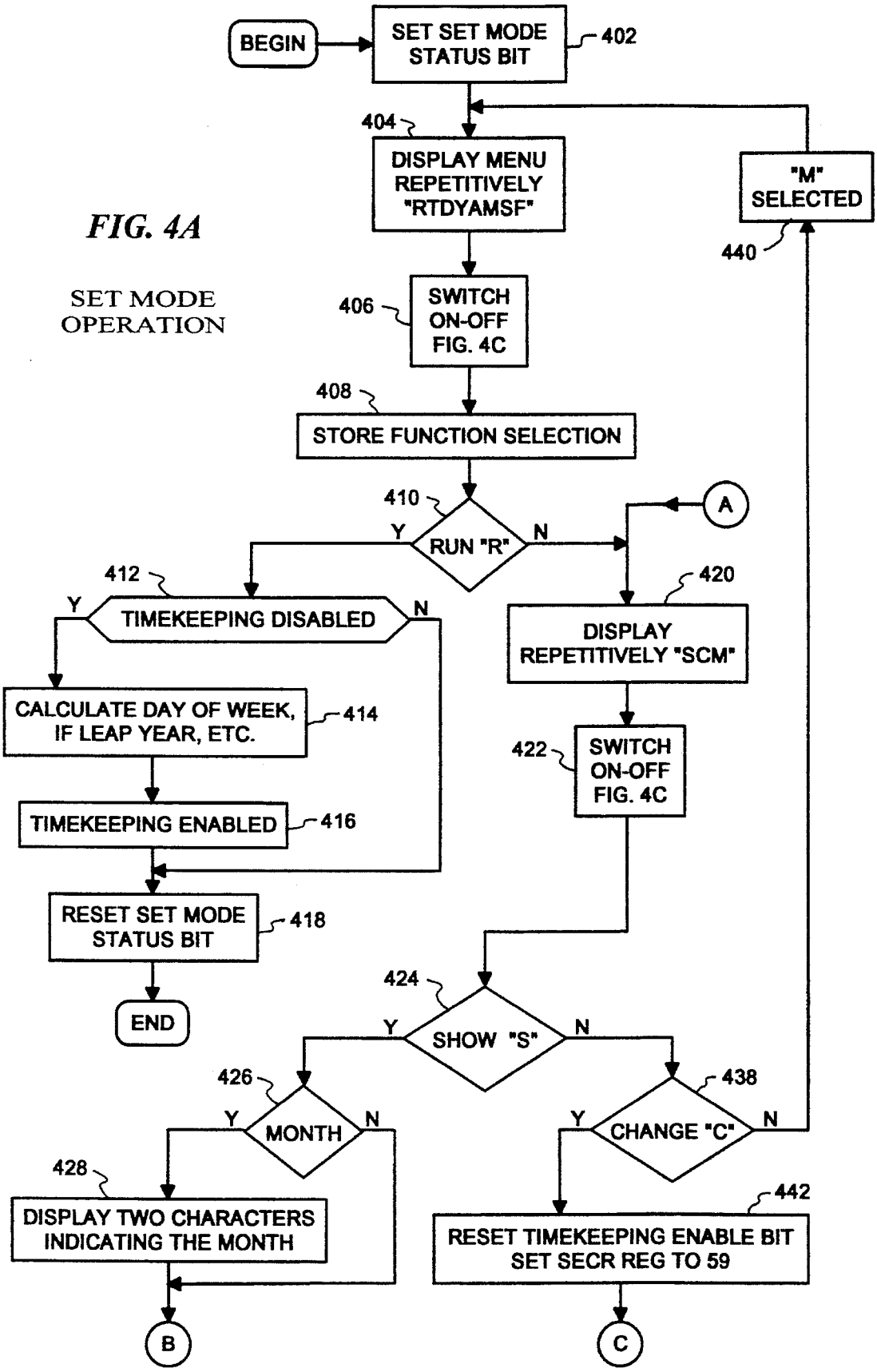
FIG. 4A is a flowchart of the set mode operation.

If changes are made to data when in set mode then a timekeeping enable bit is reset in STATUS register 154 (FIG. 4A, 442). Decision 356 examines this bit and if it is set then SECR register 138 is decremented, otherwise it is not and hence timekeeping is disabled. The automatic decrementing of decrementing counter 134, however, is not affected.

If SECR register 138 is not zero then a character is displayed for 0.92 second. During this interval the Display Subroutine Code is executed, wherein multiplex waveform data is transferred from twelve RAM registers amongst MSC 156 to output ports G, D, and L, as previously mentioned. If the value in SECR register 138 is one then decision 372 results in the subtraction of the value in SPEED register 152 from 186 with the result stored in the lower byte of autoload register 148, 374. If the value in SECR register 138 is greater than one then decision 372 bypasses changes to autoload register 148. The upper byte of autoload register 148 is a constant, being equal to 3072.

Alternately, if SECR register 138 is zero decision 360 enables a set mode test 362, where a set mode status bit in STATUS register 154 is examined, this bit being set when entering set mode (see FIG. 4A, 402). If set mode exists then a character is displayed for 0.92 second. Again a character is displayed by execution of the Display Subroutine Code. If operation is not in set mode then decision 362 bypasses character display 364, and the display is blanked for the full one second interval.

Following this, a 204 count is stored in the lower byte of autoload register 148 and SECR register 138 is set to a count of 60. The MIN 140, HOUR 142 and other timekeeping registers MSC 156 are updated 368. Included in the timekeeping updates are DST hour changes twice a year if a DST option is enabled. Additionally, on New Years day a leap year determination is made so that the number of days in February is known.

When data is changed in set mode SECR register 138 is set to a count of 59 (FIG. 4A, 442). Under such conditions decision 360 cannot be affirmative enabling minutes and possibly longer time units to be automatically updated during set mode, and would be contrary to earlier assertions.

The timing operation described above results in the lower byte of autoload register 148 being loaded to a count of 204 for 59 intervals and to a count of 186 less the user modifiable speed value in SPEED register 152 for one interval. The one second intervals have a nominal error which is corrected on a one minute basis. The SPEED value ranges from zero to fourteen and hence has a nominal value of seven. Thus, a nominal load value will be 186-7, or 179. Decrementing counter 134 actually counts one more count than loaded by autoload register 148. Assuming the minute duration is exact, the number of counts in one minute is $$\begin{aligned} N &= 59(3072+204+1)+1(3072+179+1) \\ &= 196595 \end{aligned}$$

The average number of counts per minute will be 196595/60, or 3276.58. The oscillator frequency is divided by ten 130, so that the required oscillator frequency is 32765.8 hz. The nominal oscillator frequency should be close to this value. If the user makes a one unit correction so as to increase clock speed, the count 179 above becomes 178, giving an N value of 196594. The clock minute interval will decrease by 1/196595, or 5.1 parts per million. This amounts to a 13.4 seconds per month change, for a speed adjustment of long term prior rate to ±6.7 seconds per month.

The set mode operation will now be described with reference to me flowcharts of FIGS. 4A–4C. Operation begins by setting a set mode bit in STATUS register 154 high 402. A main menu consisting of the character sequence RTDYAMSF is displayed 404, the characters being displayed individually as in normal operation, and with this sequence repeating as long as the switch is off. When switch 120 is on (depressed) a function or action corresponding to the displayed character is selected. When the switch is off (released) the operation of block 406 is completed. A number representative of the selected function is stored in a MSC 156 register, 408. Decision 410 returns the clock to normal operation if R is selected, or otherwise directs operation to a clock setting function representative of the selected character. The particular functions for the characters of this main menu are:

| | |
|---|---|
| R | Run, enter normal timekeeping operation |
| T | set the Time (hours and minutes) |
| D | set the Date, (month and day of month) |
| Y | set the Year |
| A | set the speed Adjustment |
| M | set the hour Mode (12 or 24 hour operation) |
| S | set the Spring forward DST Sunday |
| F | set the Fall backward DST Sunday |

Implicit in the display of characters for the main menu and in fact elsewhere are executions of the Display and Timekeeping Subroutine, FIG. 3. The display rate for the characters is maintained by this subroutine at a one second rate as for normal operation.

Figures 4B, 4C:
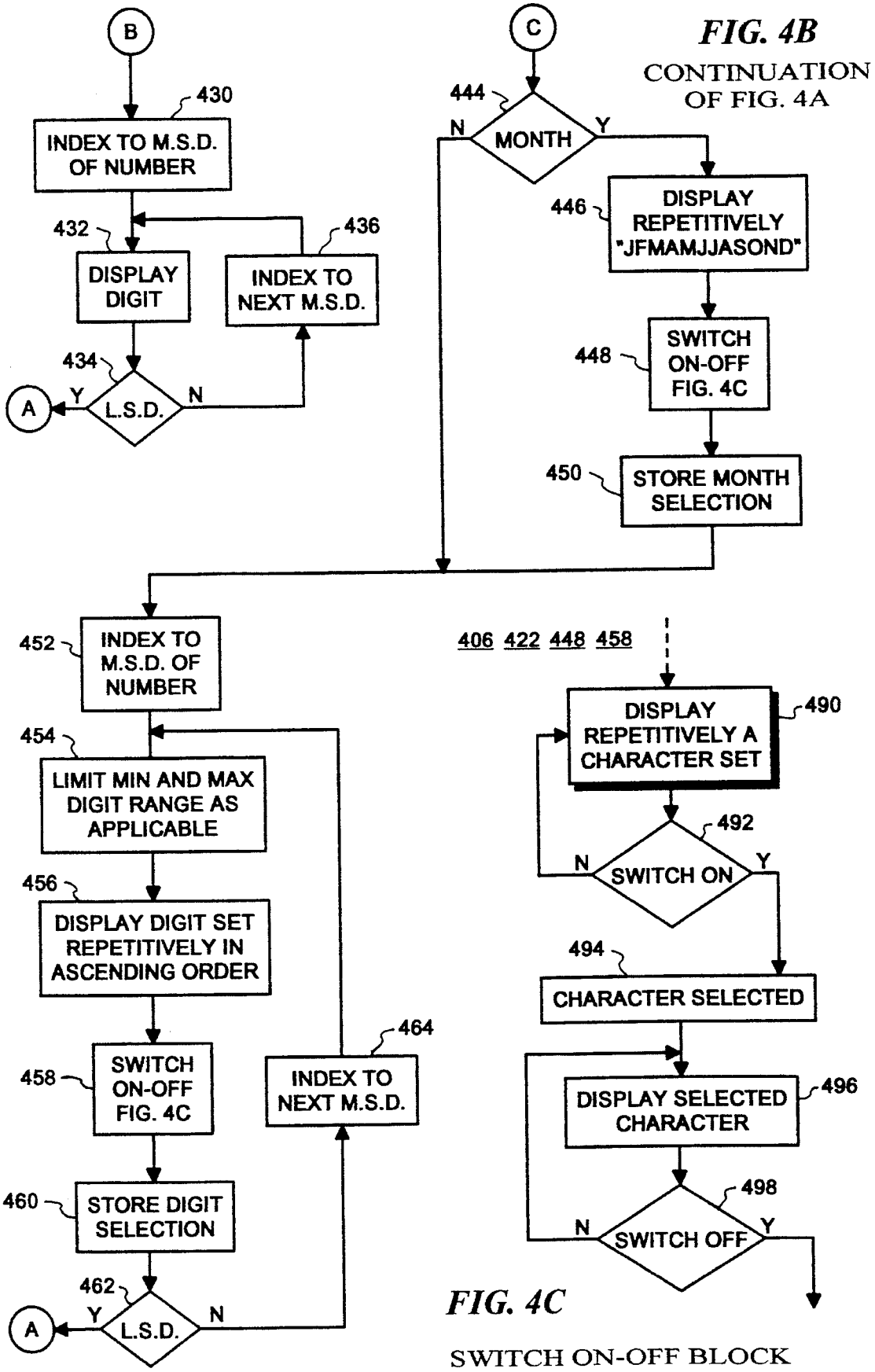
FIG. 4B is a continuation of the flowchart of FIG. 4A.
FIG. 4C is a flowchart of the Switch On-Off block.

The switch on-off block 406 has an implied feedback connection to the preceding block 404 which is further detailed in FIG. 4C. Since this block is used elsewhere a generalized sequential character set is assumed for display here. Referring to FIG. 4C, as long as switch 120 is off decision 492 is negative and thus enables characters to be sequentially selected and individually displayed at a one second rate. When the last character is displayed then the character sequence is repeated, this process continuing indefinitely as long as switch 120 is off. The feedback to block 490 is not shown at the initial entry point (at the top) but separately as this feedback is essentially a gating signal allowing sequencing to occur. When switch 120 is on the character that is being displayed is selected 494. As long as switch 120 remains on the selected character is displayed (by repeatedly accessing the Display and Timekeeping Routine) 496. When switch 120 is off operation proceeds to the next instruction and the character display ceases. By displaying a character as long as switch 120 is on a visual confirmation of the selected character is given. The relatively rapid selection rate, the multiple opportunities to make a selection, and the visual confirmation of a selection makes for a use friendly selection and setting procedure.

Returning to FIG. 4A, unless decision 410 indicates R is selected (resulting in normal operation), a menu having the character sequence SCM follows 420, the characters representative of whether the data is to be Shown, Changed, or whether a return is to be made to the first or main Menu, respectively. The sequence SCM is displayed repeatedly, similarly as for the main menu, until switch 120 is depressed. When switch on-off action has occurred 422 decision 424 routes operation to decision 426 if S is selected, or otherwise to block 438. In the latter instance if C is selected then decision 438 is affirmative, or if M is selected 440 the main menu is displayed 404. The items of the main and SCM menus thus are seen to facilitate the selection of items that ultimately set the timekeeping circuitry, thereby modifying its operation. In the claims such items are referred to as facilitating items.

Assuming S is selected, and one of the main menu selections D, S, or F is selected then data representative of a month will be displayed and hence decision 426 is affirmative. Subsequently a two character sequence representing the month is displayed 428. IF D, S, or F are not chosen then the month display 428 is skipped.

Referring to FIG. 4B, a number is then displayed. The most significant digit of the number is selected 430 and displayed 432. If the number has more than one digit then decision 434 enables selection of the next most significant digit 436, and its display 432. When the least significant digit is displayed decision 434 returns operation to 420 where the menu SCM is again displayed.

Alternately, if S is not selected (FIG. 4A) and decision 438 is affirmative then C is selected. A timekeeping enable bit is reset in STATUS register 154 disabling timekeeping (by inhibiting decrementing of SECR register 138 by means of decision 356, FIG. 3), and SECR register 138 is set to a count of 59 442. Referring now to FIG. 4B, if main menu selections are D, S, or F a month is to be changed. Decision 444 is affirmative and a display sequence corresponding to the first character of each month is displayed in chronological order 446. A month is selected by the on-off action of switch 120 448. Although several months have identical first characters any confusion as to a given month is avoided by the chronological order of the characters. Upon such selection the month is stored 450 as a number 1–12 in a MSC register 156.

Following a month selection a related number such as the day of the month or a number corresponding to a given Sunday of the month is to be set. The most significant digit of the number is automatically selected 452. A range of digits is determined based on meaningful values 454 followed by the display of an ascending order of digits 456. This sequence is repeatedly displayed until switch 120 is depressed and therefore on selecting the displayed digit. When switch 120 is off, completing the operation of 458, the selected digit is stored in one of the MSC registers 156 in RAM 460. If any lower significant digits have not been displayed then decision 462 enables selection of the next most significant digit 464 and the determination of an applicable range for possible digit choices 454. Following selection of the least significant digit, decision 462 returns operation to the menu display SCM 420, FIG. 4A. In limiting the range of digits to meaningful values 454, data errors and setting time are reduced. For example, digit choices for the tens of units minutes range are from zero through five, or the digits for the tens of units hour range (24 hour basis is used to enter hours) are from zero to two. Also, for instance, if two is selected for the tens of hours, the hour units digit is then limited to the range of zero to three. If at decision 410 R is selected and timekeeping is disabled, then additional calculations are performed such as determining the day of the week from the date inclusive of year information, if it is leap year, etc. 414. Timekeeping is then enabled 416 by setting the timekeeping enable bit in STATUS register 154. Whether or not timekeeping is disabled per decision 412 the set mode status bit is reset 418 ending set mode operation. Below, the following additional information is given concerning the display of data in set mode:

Time is set as four digits; tens of hours, unit hours, tens of minutes, and unit minutes. Hour data is set on a 24 hour basis. Two RAM registers store minute and hour information.

The date is displayed month first (two characters if examining the month or one if changing it) followed by two digits for the day of the month. Two RAM registers store the month and day of the month.

Years in the range of 0000 through 9999 may be entered. Two RAM registers store the year.

The speed adjustment value is displayed as a two digit number in the range from zero to thirteen, with zero and fourteen corresponding to the slowest and fastest speed adjustments, respectively.

The 12/24 hour mode indication is stored in RAM as a number, one or two, respectively.

DST beginning and ending dates are displayed as a month (two characters if examining the month or one if changing it) and a number from one to five. If a Sunday is given as the first through fourth Sunday of the month then a corresponding number is set, or if the Sunday is the last Sunday of the month then the number five is set. Each DST date is stored in one RAM register.

Although this clock does not display seconds it can nevertheless be set to about one second accuracy. This is accomplished when in set mode and the main menu RTDYAMSF is being displayed 404, FIG. 4A. Initially the time is set ahead by one or two minutes according to a reference clock. Clock time will be stopped. Then R is selected to begin the normal display mode, switch 120 is held on until the desired time and then released. The time will be accurately set. As may be noted from FIG. 4C for the switch on-off block, when a character is selected and as long as switch 120 is on, a loop is established with the selected character being continuously displayed, in this case being R. When the switch is released and after some preliminary calculations 414 normal operation resumes. In that the time to execute preliminary calculations 414 prior to displaying the first hour digit results in a timer underflow in which the SECR register 138 is not decremented, the desired one second accuracy is achieved by making an allowance for a skipped decrement by setting SECR register 138 to a count of 59, one less than for normal operation.

Figure 5:
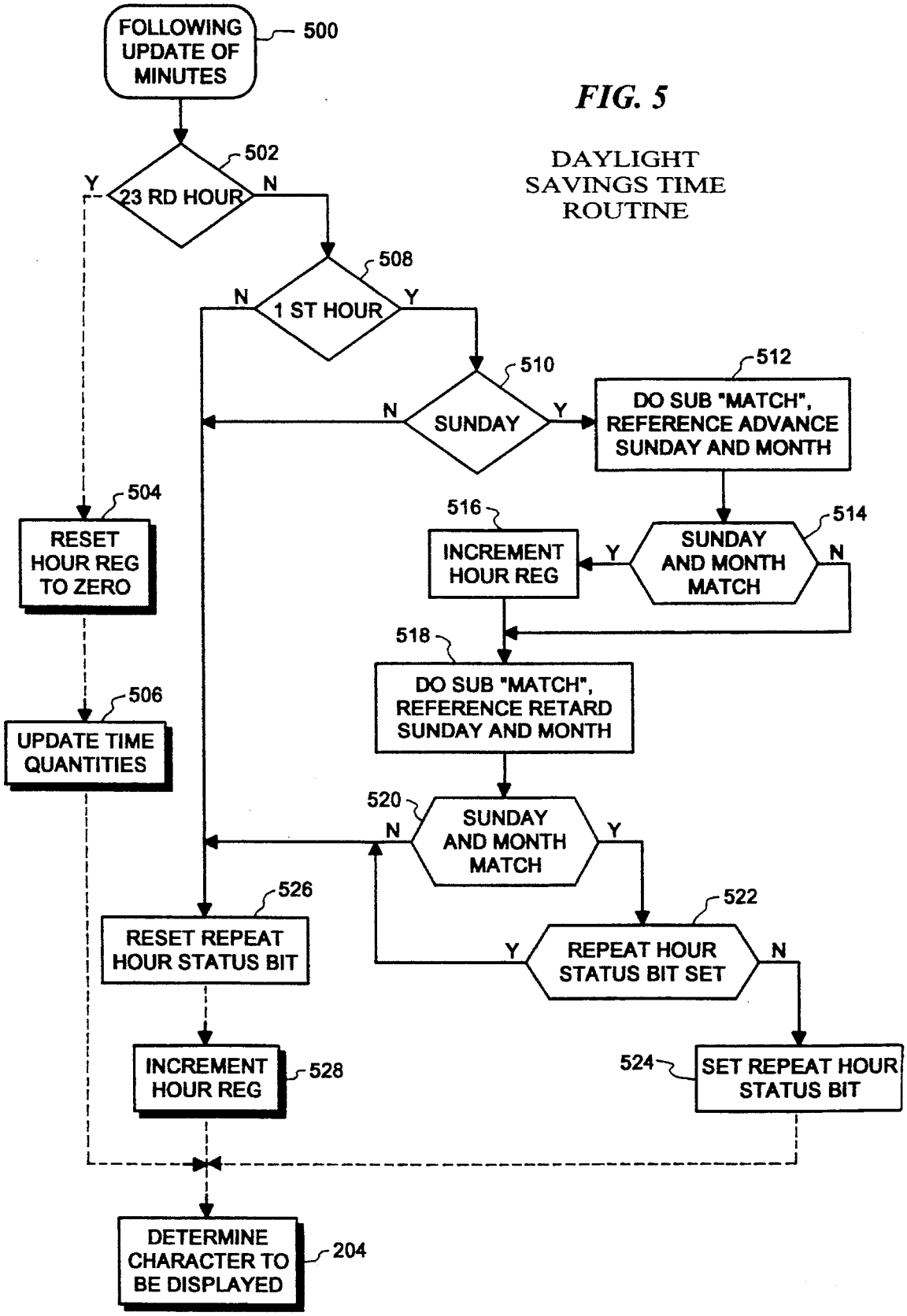
FIG. 5 is a flowchart of the Daylight Savings Time Routine.

Referring to the flowchart of FIG. 5, the DST Routine (a portion of block 368, FIG. 3) is described in some detail. Hours are stored in HOUR register 142 on a 24 hour basis. DST time changes are assumed to occur on Sundays at 2 AM. The hour checks are based on data stored in HOUR register 142, this register not being yet incremented for the current hour. Following the update of minutes 500 (also part of block 368), a 23rd hour check 502 is made. If it is the 23rd hour then no DST corrections apply and HOUR register 142 is reset to zero 504, other time quantities are updated 506, and operation continues with the determination of the next character to be displayed 204. The dashed lines and shadowed blocks are used to signify normal operation exclusive of the DST Routine. If decision 502 indicates it is not the 23rd hour then a first hour check 508 is made. If it is not the first hour then a repeat hour status bit is reset 526, HOUR register 142 is incremented 528, and the next character is determined for display 204. If decision 508 indicates it is the first hour then a Sunday check 510 is made. Reference is then made to one of MSC RAM registers 156 that stores the day of the week (DOW). If it is not a Sunday then the repeat hour status bit is reset 526 followed by an hour increment 528. If it is a Sunday then subroutine Match is executed 512 to determine if the current Sunday and specified Spring-forward Sunday match. If decision 514 indicates a match the HOUR register 142 is incremented 516 (the hour will be incremented twice). Regardless of decision 514 subroutine Match is again executed 518 to determine if the current Sunday and Fall-back Sunday match. If decision 520 indicates no match or decision 522 indicates the repeat hour status bit is set then the repeat hour status bit is reset 526 followed by an increment of the HOUR register 142, 528. If there is a match and the repeat hour status bit is not set then the repeat hour status bit is set 524, the setting of the repeat hour status bit 526 and the hour increment 528 are skipped, and operation continues with the determination of the next character to be displayed 204.

When DST ends the clock is turned back one hour. This is simply done by not incrementing the hour (hour increments 516 or 528 do not occur). However, one hour later the value in HOUR register 142 remains at one and the hour again would not be incremented unless means exists to remember that this is the second time around. The repeat hour status bit serves this purpose. On the first occurrence of one o'clock this bit is set, so that upon the second occurrence of one o'clock this bit being set enables a normal hour increment. This bit is then reset so that hour increments are no longer inhibited.

Figure 6:
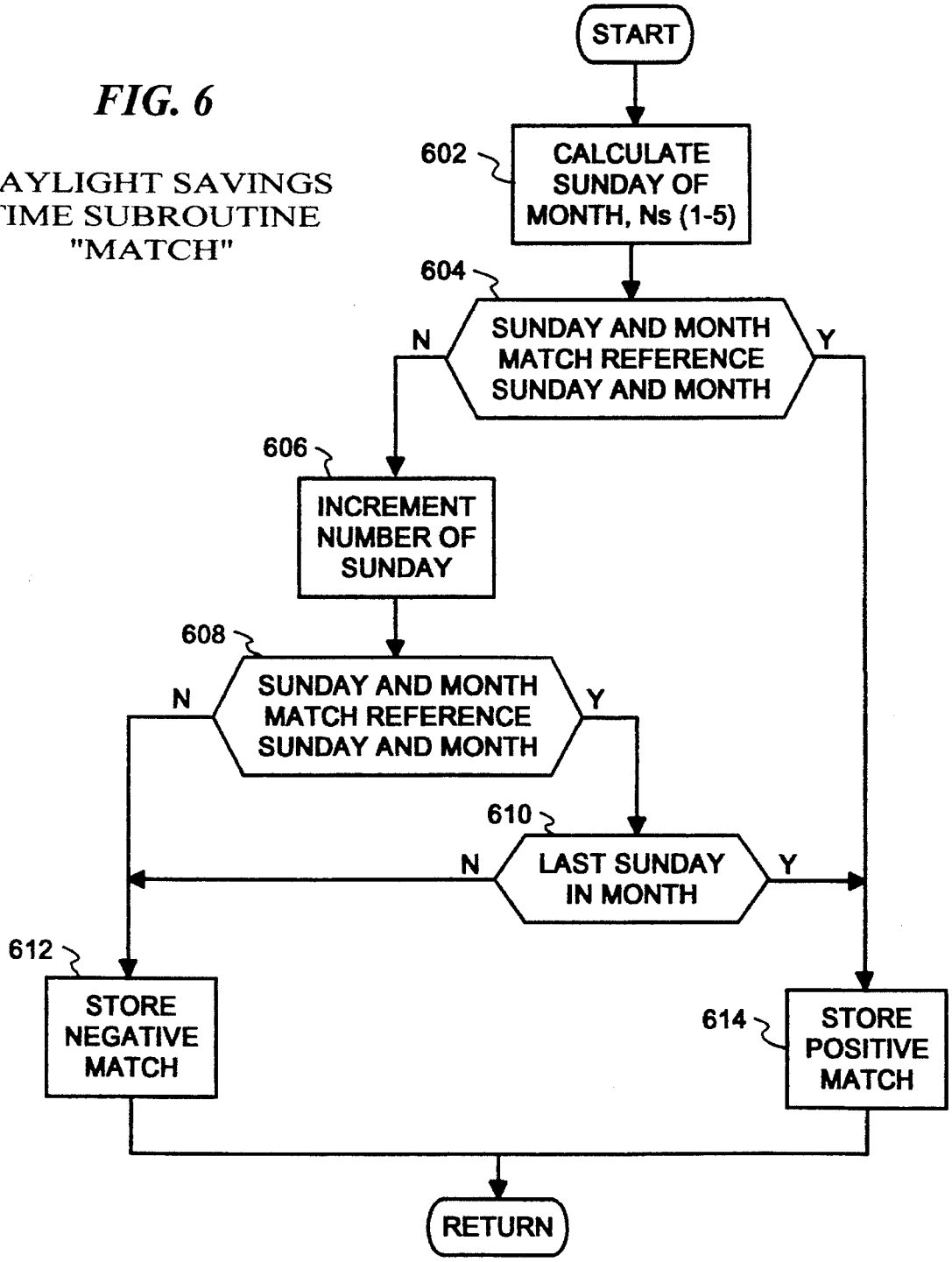
FIG. 6 is a flowchart of the Daylight Savings Time Subroutine "MATCH."

In FIG. 6 a flowchart of the subroutine Match is given (executed from the DST routine). A MSC register 156 serves as a pointer to the stored beginning or ending DST Sunday in RAM. The number of a Sunday in a given month cannot always be found by simply counting Sundays from the first of the month owing to power-up or setting considerations. Also it should be recognized that a last Sunday can occur on the fourth or fifth Sunday of a given month. Thus on each Sunday a calculation is made of the Sunday it is in the month 602 (without regard to last Sunday of the month considerations), being evaluated from the formula, $$N_S = INT\left[\frac{1}{7}(DOM-1)+1\right],$$

where INT refers to taking the integer portion of the argument, and DOM refers to the day of the month. If decision 604 indicates a match between the month and the number of Sunday $N_S$ to the reference month and Sunday then a positive match status is stored 614, e.g. by setting a carry bit. If no match exists then the number of Sunday $N_S$ is incremented 606, and a repeat Sunday and month match examination 608 is made. If there is no match or it is not the last Sunday in a month then a negative match status is stored 612, e.g. by resetting the carry bit. If decision 608 indicates a match and decision 610 indicates that it is not the last Sunday in the month then a negative match status again is stored 612. The reason for the increment at 606 is to check for a last Sunday match. If at 602 $N_S$ evaluates to four and decision 604 is negative, then $N_S$ is incremented to five 606, so that decision 608 if affirmative enables a last Sunday DST check 610. If affirmative a positive match is stored 614. Decision 610 is affirmative when the following inequality is true:

$$DOM > DIM-7,$$

where DIM refers to the number of days in the given month.

Following storing of the match condition, 612 or 614, a return is made to the DST Routine.

TABLE 1

| | | ROM Bit Reference Designations | | | | | | | |
|---|---|---|---|---|---|---|---|---|---|
| BIT | | 7 | 6 | 5 | 4 | 3 | 2 | 1 | 0 |
| ROM | 1 | 17 | 16 | 15 | 14 | 13 | 12 | 11 | 10 |
| BYTE | 2 | 27 | 26 | 25 | 24 | 23 | 22 | 21 | 20 |
| | 3 | 37 | 36 | 35 | 34 | 33 | 32 | 31 | 30 |
| | 4 | 47 | 46 | 45 | 44 | 43 | 42 | 41 | 40 |

A more detailed description of the generation of duplex multiplex waveforms from data in RAM will be now be given. In Table 1 above, four bytes that define the appearance of a given character are indicated. A number is assigned to each bit position for each byte, the digits referring to the byte number and bit location.

Table 2 below gives the locations of the above designated ROM bits and their complements in RAM, hexadecimal locations 0F to 1A. The instruction code for generating the data is not given; however, one who is skilled in the art of programming and who is familiar with the instruction code set for COP820C microcontroller 110 should have no difficulty in writing appropriate code given the information in Tables 1 and 2.

Referring to Table 2, the ports that each of the twelve bytes are transferred to are indicated. Port D has four outputs corresponding to bits 0–3 with bits 4–7 being irrelevant. Port G has six outputs, four corresponding to bits 0–3, and two corresponding to bits 4–5 that apply to generation of backplane waveform generator signals, FIG. 7A–7C. The sixth bit of port G is set to zero as a matter of choice. The seventh bit must be zero or microcontroller 110 will enter a halt mode. Port L has eight outputs. Its seventh bit is always unity (received from ROM locations 27 and 47) and facilitates generation of a clock high level signal (see CLK, FIG. 7C).

TABLE 2

| | | ROM Bit Locations in RAM | | | | | | | | |
|---|---|---|---|---|---|---|---|---|---|---|
| BIT | | 7 | 6 | 5 | 4 | 3 | 2 | 1 | 0 | PORT |
| RAM | 0F | X | X | X | X | 13 | 12 | 11 | 10 | D |
| REG. | 10 | 0 | 0 | 0 | 1 | 17 | 16 | 15 | 14 | G |
| | 11 | 27 | 26 | 25 | 24 | 23 | 22 | 21 | 20 | L |
| | 12 | X | X | X | X | 33 | 32 | 31 | 30 | D |
| | 13 | 0 | 0 | 0 | 1 | 37 | 36 | 35 | 34 | G |
| | 14 | 47 | 46 | 45 | 44 | 43 | 42 | 41 | 40 | L |
| | 15 | X | X | X | X | *13* | *12* | *11* | 10 | D |
| | 16 | 0 | 0 | 0 | 0 | *17* | *16* | *15* | *14* | G |
| | 17 | 27 | *26* | *25* | *24* | *23* | *22* | *21* | *20* | L |
| | 18 | X | X | X | X | *33* | *32* | *31* | *30* | D |
| | 19 | 0 | 0 | 0 | 0 | *37* | *36* | *35* | *34* | G |
| | 1A | 47 | *46* | *45* | *44* | *43* | *42* | *41* | *40* | L |

BITS THAT HAVE ITALLIC REFERENCES ARE INVERTED.
X REPRESENTS DON'T CARE BITS.
0 AND 1 ARE FIXED BIT VALUES.
BIT POSTIONS FOR PORT DATA ARE IDENTICAL TO RAM BIT POSITIONS.

The relatively compact instruction code (39 bytes) for the Display Subroutine is given in Table 3 below. The program begins with the loading of one of the MSC 156 registers, symbolically given as XCYCTR, to a decimal count of 29. A pointer associated with an X register (a dedicated special purpose register amongst the MSC 156 registers) is set to the location of the D register in RAM (at location hexadecimal DC), the destination of the first byte transfer. A jump is made to ROM address 02ED (symbolic address DISPB) where a pointer associated with a B register (a dedicated special purpose register amongst the MSC 156 registers) is set to starting RAM address 0F for the data transfer (see Table 2). The XCYCTR register is decremented and as it is not zero a transfer occurs to 02ED (symbolic address DISPC). Instructions at 02E0–02E1 transfer the first byte to the D register, instructions at 02E2–02E3 transfer the second byte to the G register, and instructions at 02E2–02E3 the L register. The seventh bit of the L register is set to one.

At address 02E8 the seventh output (corresponding to the seventh bit) of the L register is reset. The B pointer is now at 11. Since the last digit of this pointer is not equal to hexadecimal A (decimal 10) a jump to 02DE (symbolic address DISPA) occurs. Data is now transferred from addresses 12–14 to D, G, and L registers, respectively. The seventh output of the L register is again reset. The B pointer is now at 14. A jump again is made to 02DE (symbolic address DISPA). Data is transferred from locations 15–17 to D, G, and L registers, respectively. The clock bit is again reset. The B pointer is now at 17. Again a jump is made to 02DE (symbolic address DISPA). Data is transferred from locations 18-1A to D, G, and L registers, respectively. Again the clock output is reset. The B pointer is now at 1A. Since the last digit of the pointer is A the instruction following the jump instruction is executed. The B pointer is reinitialized to 0F. The XCYCTR register is decremented and a jump is made to 02E0 (symbolic address DISPC). The above instruction sequence is repeated a number of times equal to one less than the initial count loaded in the XCYCTR register, or 28 times. On the 28th repetition the XCYCTR register decrements to zero. Dummy cycles are then introduced for timing purposes followed by the D, G, and L registers being appropriately set to establish low logic levels for LCD drive signals, 174 and 176. These signals are latched at low logic levels until the Display Subroutine is again accessed. LCD 178 is therefore blank and hence the so called blanking interval begins. Microcontroller 110 is now free to process instructions for timekeeping and other purposes.

In the Display Subroutine code the number of instruction cycles to execute an instruction is given in the last column. When jumps occur two values are given corresponding to the number of cycles for a jump or to begin execution of the next instruction, respectively. An examination of the program sequencing will show that the intervals between L port loadings are always 27 cycles, which will insure that waveforms have equal length periods of high and low levels, and that nearly DC free voltages across LCD element electrodes results. The fundamental multiplex frequency corresponds to the reciprocal of the time to execute 4×27 or instruction cycles. For a nominal instruction cycle frequency of 3276.6 hz, the fundamental multiplex frequency is 3276.6/108, or 30.3 hz. The number of instruction cycles a given character is displayed is 28×108, or 3024. This represents a time of 3024/3276.6, or 0.92 second. Hence, the blanking interval will be 1–0.92, or 0.08 second.

TABLE 3

Display Subroutine

| Address (Hex) | Opcode (Hex) | Address (Symbolic) | Opcode Mnemonic | Instruction Cycles |
|---|---|---|---|---|
| 02D9 | DFID | DISP: | XCYCTR, #29 | 3 |
| 02DB | DCDC | | LD X, #D | 3 |
| 02DD | 0F | | IP DISPB | 3 |
| 02DE | BE | DISPA: | LD A,[X] | 3 |
| 02DF | AA | | LD A,[B+] | 2 |
| 02E0 | AA | DISPC: | LD A,[B+] | 2 |
| 02E1 | B6 | | X A,[X]; Da>D | 3 |
| 02E2 | AA | | LD A,[B+] | 2 |
| 02E3 | 9CD4 | | X A,G; Ga>G | 3 |
| 02E5 | AE | | LD A,[B] | 1 |
| 02E6 | 9CD0 | | X A,L; La>L | 3 |
| 02E8 | BDD06F | | RBIT #7,L | 4 |
| 02EB | 4A | | IFBNE #10 | 1 |
| 02EC | F1 | | JP DISPA | 3/1 |
| 02ED | 50 | DISPB: | LD B, #00F | 1 |
| 02EE | CF | | DRSZ XCYCTR | 3 |
| 02EF | F0 | | JP DISPC | 3/1 |
| 02F0 | BE | | LD A, [X] | 3 |
| 02F1 | BE | | LD A, [X] | 3 |
| 02F2 | B8 | | NOP | 1 |
| 02F3 | BCD420 | | LD G, #020 | 3 |
| 02F6 | BCDC00 | | LD D, #0 | 3 |
| 02F9 | BCD080 | | LD L, #080 | 3 |
| 02FC | BDD06F | | RBIT #7,L | 4 |
| 02FF | 8E | | RET | 5 |

Figure 7A:
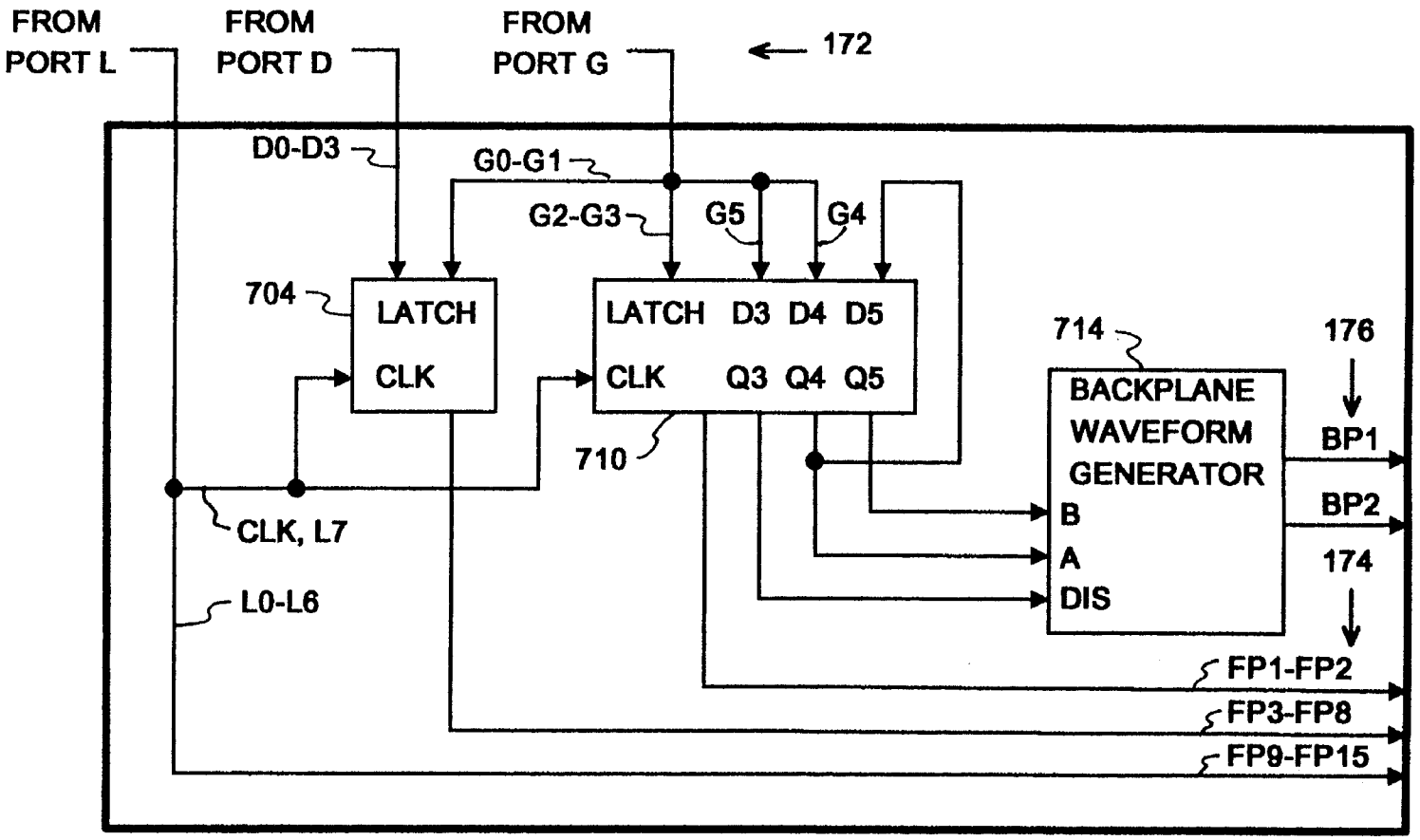
FIG. 7A is a schematic/block diagram of the LCD driver.

A schematic/block diagram of LCD driver 170, FIG. 1, is given in FIG. 7A. The signals from output ports D, G, and L 172 are received by LCD driver 170, which generates LCD frontplane drive signals 174 and backplane drive signals 176 that directly drive LCD 178. Reference designations D0–D3, G0–G5, and L0–L6 denote port D, G, and L outputs corresponding to individual port bit locations. Latch 710 input D3 should not be confused with the third output D3 of port D and care will be taken to avoid any such confusion.

As each port is separately loaded the resultant delay in port D and L outputs will decrease RMS on voltage and increase RMS off voltage, decreasing LCD element contrast. While the effects of these delays are small they are not entirely negligible (but could be for oscillator frequencies around 100 khz and higher or when using super twist LCD's).

The contrast reductions owing to delays in port outputs are eliminated by latches 704 and which resynchronize microcontroller multiplex signals 172. These latches are six bit standard high speed CMOS latches, 74HC174. The seventh output of port L–L7, will alternately be referred to as CLK as it is the clock signal for latches 704 and 710, being connected to their CLK inputs.

TABLE 4

| | | Frontplane Line Numbers | | | | | | | |
|---|---|---|---|---|---|---|---|---|---|
| BIT | | 7 | 6 | 5 | 4 | 3 | 2 | 1 | 0 |
| PORT | D | | | | | 5 | 6 | 7 | 8 |
| | G | | | | | 1 | 2 | 3 | 4 |
| | L | | 9 | 10 | 11 | 15 | 14 | 13 | 12 |

In Table 4 above the relationship between frontplane lines and port bit locations is given. Making use of this data it follows that when CLK goes high latch input signals G3–G0 and D3–D0 are transferred to latch outputs and thereby frontplane lines FP1–FP8, respectively. Also signals G5 and G4 at latch inputs D3 and D4 are transferred to latch outputs Q3 and Q4 at this time. Latch output Q4 is connected to latch input D5, this resulting in latch output Q5 replicating latch output Q4 after one CLK period delay. Seven port L signals L0–L6 serve also as frontplane drive signals FP9–FP15 that drive LCD 178. The port L signals L0–L6 are not latched as a negligible delay exists between their transition times and that of latched signals FP1–FP8, Q3, Q4, and Q5. Latch outputs Q3, Q4, and Q5 are connected to inputs DIS (disable), A, and B of backplane waveform generator 714. The outputs 176 of backplane waveform generator 714 are backplane drive signals BP1 and BP2.

The Display Subroutine begins by transferring bytes at RAM addresses 0F, 10, and 11 to ports D, G, and L (see Table 2 and instruction code at addresses 02ED, 02E0–02E6, Table 3). ROM bits 13–10 are transferred to port D locations 3–0, bits, 17–14 are transferred to port G locations 3–0, and bits 27–20 are transferred to port L locations 7–0, respectively. Additionally, bits 5 and 4 from RAM location 10 are transferred to locations 5 and 4 of port G, making latch inputs D3 and D4 low and high, respectively. The CLK output of port L goes high transferring the inputs of latches 704 and 710 to their outputs with port L outputs L0–L6 being also frontplane drive signals FP9–FP15. The CLK output at port L is reset. Latch 710 outputs Q3, Q4, and Q5 are low, high, and low respectively. The output Q5 depends on the prior state of Q4 and can be high upon power up, but after a complete multiplex cycle it must be low as Q4's output will have been low, as will become evident. Thus backplane waveform generator inputs DIS, A, and B are low, high, and low, respectively. The period for this logic state, corresponding to the first CLK period 1, is from the positive transition of CLK pulse 1 to the positive transition of CLK pulse 2, FIG. 7C. With the exception of disable signal DIS going low, the logic descriptions apply to subsequently labeled CLK 1 periods.

RAM data is now transferred from RAM locations 12–14 to G, D, and L registers, respectively. ROM bits 33–30 are transferred to port D locations 3–0, bits 37–34 are transferred to port G locations 3–0, and bits 47–40 are transferred to port L locations 7–0, respectively. Additionally, bits 5 and 4 from RAM location 13 are transferred to locations 5 and 4 of port G, making latch inputs D3 and D4 low and high, respectively. The CLK output of port L goes high transferring the inputs of latches 704 and 710 to their outputs with port L outputs L0–L6 being also frontplane drive signals FP9–FP15. The CLK output at port L is reset. Latch 710 outputs Q3, Q4, and Q5 are low, high, and high, as also are backplane waveform generator inputs DIS, A, and B, respectively. These levels apply for CLK period 2 similarly as for CLK period 1 above and to subsequent CLK period 2 intervals.

Data is now transferred from RAM locations 15–17 to G, D, and L registers, respectively. Except for the seventh bit of port L ROM bits are now inverted. Inverted ROM bits 13–10 are transferred to port D locations 3–0, inverted bits 17–14 are transferred to port G locations 3–0, and inverted bits 27–20 are transferred to port L locations 7–0, respectively. Additionally, bits 5 and 4 from RAM location 16 are transferred to locations 5 and 4 of port G, making latch inputs D3 and D4 both low. The CLK output of port L goes high transferring the inputs of latches 704 and 710 to their outputs with port L outputs L0–L6 also being frontplane drive signals FP9–FP15. The CLK output at port L is reset. Latch 710 outputs Q3, Q4, and Q5 are low, low, and high, as also are backplane waveform generator inputs DIS, A, and B, respectively. These levels apply for CLK period 3 and subsequent CLK period 3 intervals.

Data is now transferred from RAM locations 18-1A to G, D, and L registers, respectively. Inverted ROM bits 33–30 are transferred to port D locations 3–0, inverted bits 37–34 are transferred to port G locations 3–0, and inverted bits 47–40 are transferred to port L locations 7–0, respectively. Additionally, bits 5 and 4 from RAM location 19 are transferred to locations 5 and 4 of port G, making latch inputs D3 and D4 both low. The CLK output of port L goes high transferring the inputs of latches 704 and 710 to their outputs with port L outputs L0–L6 also being frontplane drive signals FP9–FP15. The CLK output at port L is reset. Latch 710 outputs Q3, Q4, and Q5 are all low and also backplane waveform generator inputs DIS, A, and B. These levels apply for CLK period 4 and subsequent CLK period 4 intervals.

This completes one multiplex waveform cycle. As discussed in describing the Display Subroutine, 28 cycles are executed based on a preload value of 29 for the XCYCTR register. For brevity only four cycles are given in FIG. 7C. Following these cycles a fifth CLK period 0 takes place where frontplane 174 and backplane signals 176 are set to low logic levels.

Figure 7B:
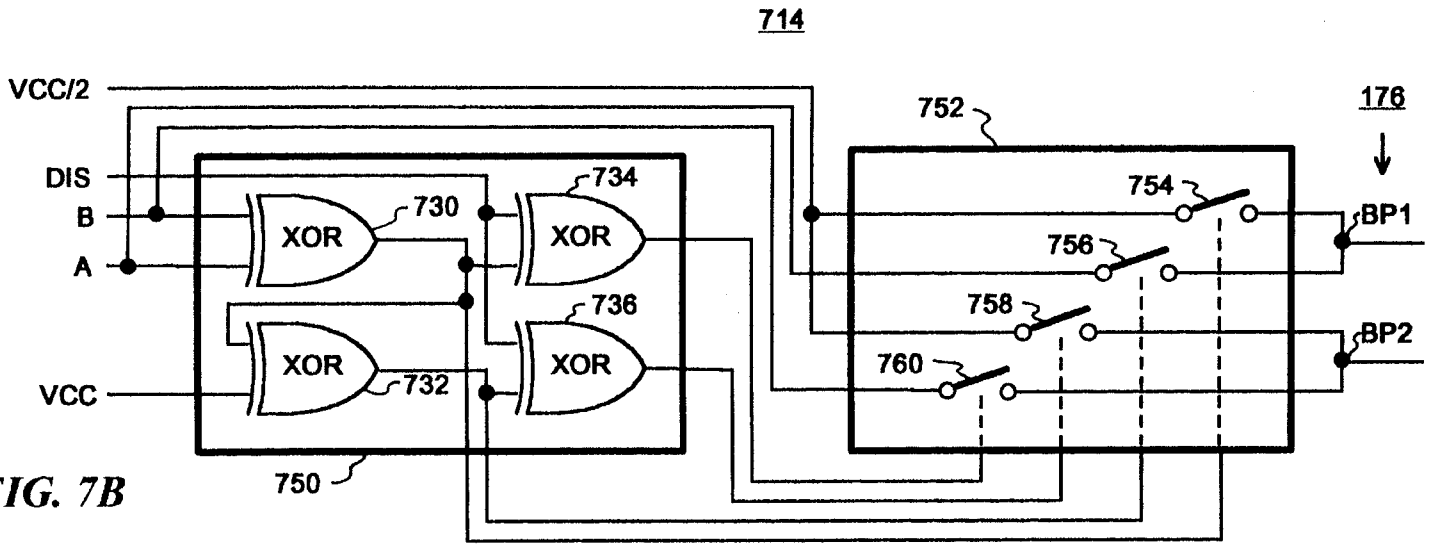
FIG. 7B is a schematic of the LCD backplane waveform generator.
Figure 7C:
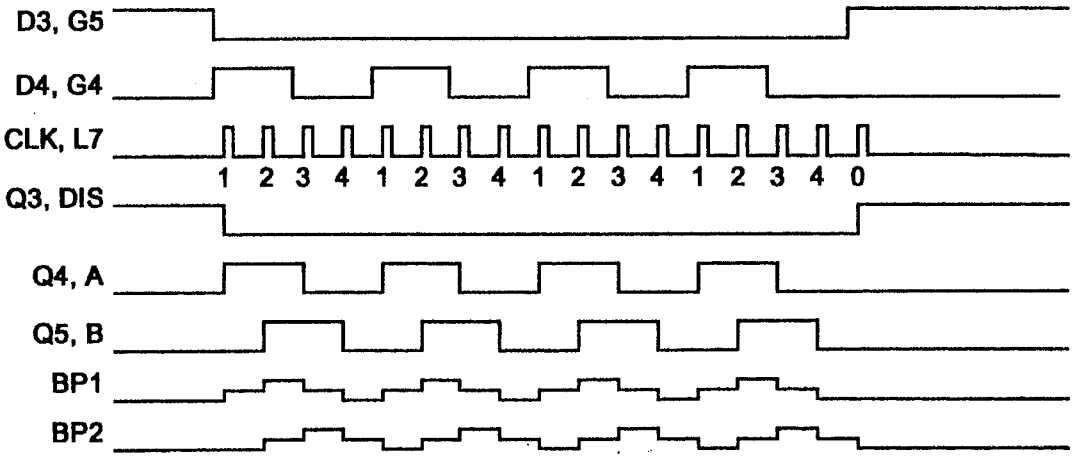
FIG. 7C is a timing diagram of LCD backplane related waveforms.

At address 02F3, Table 3, port G inputs are high or low according to the bit values represented by the hexadecimal number 020, which in binary is 00100000, hence output G5 is high and outputs G4–G0 are low. The first two zeros of the binary number are ignored as port G has only six outputs. Thus latch 704 inputs receiving lines G0–G1 are low, latch 710 inputs receiving lines G2–G3 are low, and latch 710 inputs at D3 and D4 are high and low, respectively. At address 02F6, port D is set to hexadecimal 0 making latch 704 inputs D0–D3 low. At address 02F9 port L is loaded to hexadecimal 080, which is binary 1000000, making its outputs L0–L6 and therefore frontplane lines FP9–FP15 low. The CLK output goes high transferring the inputs of latches 704 and 710 to their outputs. Latch outputs Q3 and Q4 will be high and low, respectively. Since latch output Q4 is low before the CLK positive transition, output Q5 goes low. The description for the backplane waveform generator 714 will show that the backplane lines BP1 and BP2, FIGS. 7B and 7C, are low at this time. Hence all LCD drive lines 174 and 176 are low and a blanking interval begins.

A schematic of the backplane waveform generator 714 is shown in FIG. 7B. This circuitry consists of two standard quad high speed CMOS integrated circuits, an exclusive-or (74HC86) 750 and an analog switch (74HC4066) 752. Exclusive-or 750 consists of exclusive-or gates 730, 732, 734, and 736 while the analog switch 752 consists of analog switches 754, 756, 758, 760 together with their lotto control inputs. A supply voltage source equal to half the clock supply voltage Vcc/2 is connected to the left terminals of switches 754 and 758. The DIS signal is connected to the upper inputs of exclusive-or's 734 and 736. The B signal is connected to the upper input of exclusive-or 730 and left terminal of switch 760. The A signal is connected to the lower input of switch 730 and the left terminal of switch 756. The clock supply voltage source Vet is connected to the lower input of exclusive-or 732 to establish a high logic input level.

The output of exclusive-or 730 is connected to the upper input of exclusive-or 732, the lower input of exclusive-or 734, and the control input to analog switch 754. The output of exclusive-or 732 is connected to the lower input of exclusive-or 736, and the control input to switch 756. The outputs of exclusive-or's 734 and 736 are the control inputs to switches 760 and 758, respectively. The right hand terminals of switches 754 and 756 are connected to a common node which is the backplane number 1 output BP1, while the right hand terminals of switches 758 and 760 are connected to a common node which is the backplane number 2 output BP2.

An exclusive-or output is high when one of its inputs is high and the other is low. The analog switches 754–760 are open or closed according to their control input being low or high, respectively. The backplane waveform signal levels at BP1 and BP2 are determined by the state of the backplane waveform generator 714 inputs, A, B, and DIS (disable).

Referring to FIG. 7C, at the beginning of first CLK period 1 corresponding to the positive transition of the CLK I pulse, the DIS, A, and B in, puts are low, high, and low, respectively. The outputs of exclusive-or gates 730, 732, 734, 736 are therefore high, low, high, and low, respectively. The control inputs to switches 754 and 760 are high setting these switches on, and control inputs to switches 756 and 758 are low setting these switches off. Thus switch 754 connects BP1 to Vcc/2 while switch 760 connects BP2 to B, making BP2 low.

At clock period 2 the DIS, A, and B inputs are low, high, and high, respectively. The outputs of exclusive-or gates 730, 732, 734, 736 are low, high, low, and high, respectively. The control inputs to switches 756 and 758 are high setting these switches on, and control inputs to switches 754 and 760 are low setting these switches off. Thus switch 756 connects BP1 to A, making BP1 high, while switch 758 connects BP2 to Vcc/2.

At clock period 3 the DIS, A, and B inputs are low, low, and high, respectively. The outputs of exclusive-or gates 730, 732, 734, 736 are low, high, low, and high, respectively. The control inputs to switches 754 and 760 are high setting these switches on, and control inputs to switches 756 and 758 are low setting these switches off. Thus switch 754 connects BP1 to Vcc/2, while switch 760 connects BP2 to B, making BP2 high.

At clock period 4 the DIS, A, and B inputs are all low. The outputs of exclusive-or gates 730, 732, 734, 736 are low, high, low, and high, respectively. The control inputs to switches 756 and 758 are high setting these switches on, and control inputs to switches 754 and 760 are low setting these switches off. Thus switch 756 connects BP1 to A, making BP1 low, while switch 758 connects BP2 to Vcc/2.

The above logic sequence is repeated for 28 clock periods (for brevity only four such periods are shown in FIG. 7C). The frontplane signals FP1–FP15 are of four possible phases, being identical to inputs A, B, or their logical inverses. The average DC value of these waveforms is Vcc/2. An examination of backplane waveforms BP1 and BP2, FIG. 7C shows that an equal number of high and low logic levels occur so that the average voltage for these waveforms is Vcc/2. Hence the DC voltage across the LCD elements during this period is nearly zero, being limited to minor residual components.

Following 28 clock periods, clock period 0 begins. The disable input DIS goes high. The A and B inputs are both low. The outputs of exclusive-or gates 730, 732, 734, 736 are low, high, high, and low, respectively. The control inputs to switches 756 and 760 are high setting these switches on, and control inputs to switches 754 and 758 are low setting these switches off. Thus switch 756 connects BP1 to A, making BP1 low while switch 760 connects BP2 to B, making BP2 low. The voltages across LCD elements during this blanking period are nearly zero, again being limited to minor residual components.

The supply voltage source Vcc/2 should be precisely half of Vcc for maximum LCD contrast. Assuming Vcc is obtained by a series connection of two 1.5 V cells, with the negative terminal of one cell going to ground and the positive terminal of the other cell being Vcc, then Vcc/2 may be taken from the connecting point for the two cells. Owing to the fact that LCD element capacitances have voltage values alternating between Vcc and ground levels, the effect of switch closures is to alternately charge and discharge the ground connected cell. The net result is that the ground connected cell is unloaded by the multiplex circuit connection. Thus assuming two identical cells, the voltage of the two cells should track throughout their load-life history and thus the Vcc/2 assumption should be reasonably true.

Because of the equal charging and discharging effects described it is possible to eliminate the Vcc/2 connection to the cells and make the connection instead to a capacitor. The capacitor voltage will be close to Vcc/2 owing to equal charging and discharging effects. To avoid voltage ripple effects affecting LCD element contrast, and subject to a limited study it appears that the capacitance should be twenty-five or so times the backplane to frontplane capacitance, assuming frontplane lines are temporarily connected together.

Figure 8:
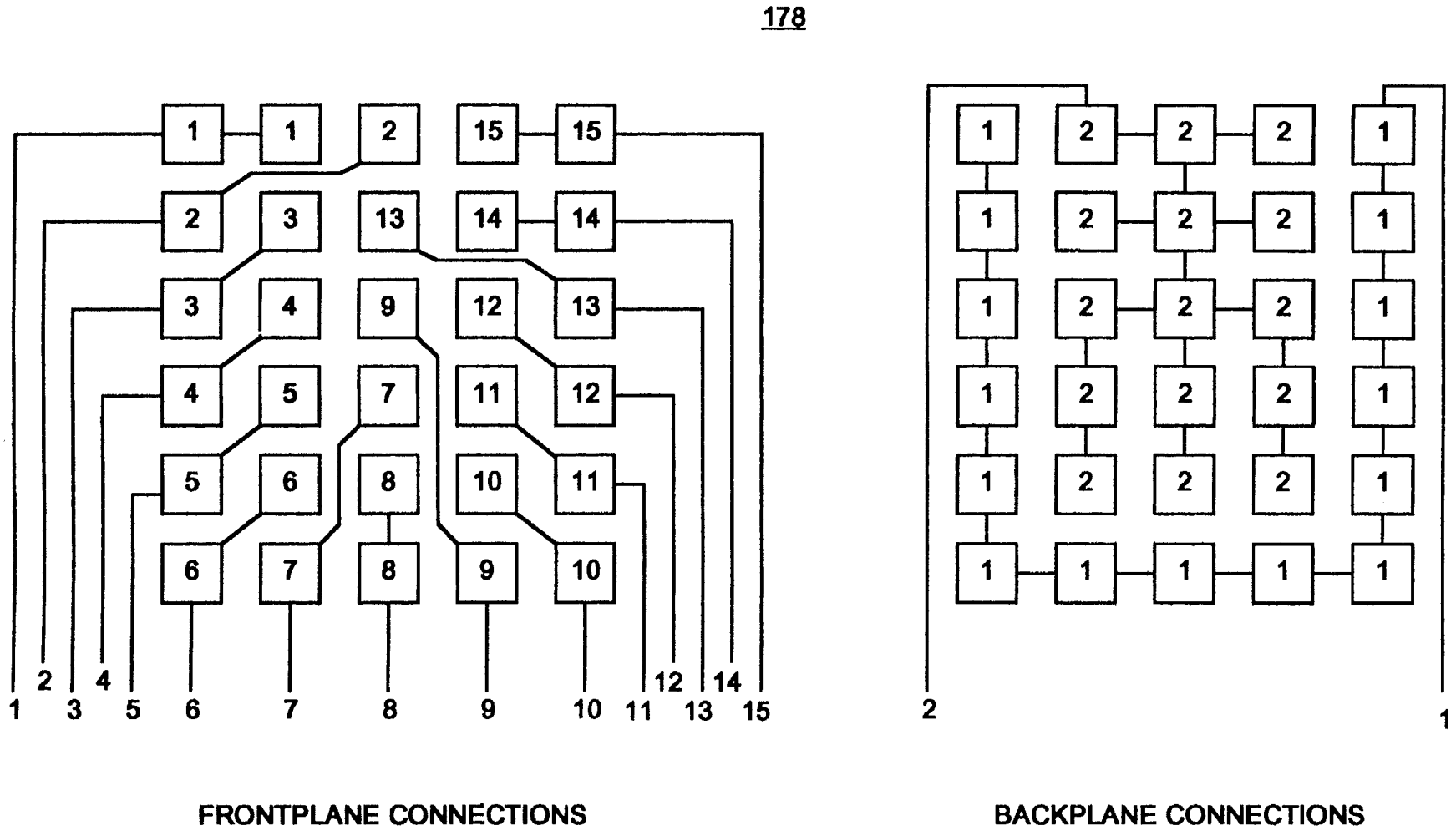
FIG. 8 is a diagram showing LCD element frontplane and backplane connections.

In FIG. 8 LCD 178 frontplane lines FP1–FPI5, backplane lines BP1 and BP2, and their element connections are given. The left and right figures shows numbers corresponding to frontplane lines FP1–FP15 and backplane lines BP1 and BP2, respectively. Each frontplane line is connected to the frontplane electrodes of a pair of elements, while backplane lines are connected individually to each element backplane electrode. The frontplane and backplane connections should not cross within the viewing area or the crossing point will be displayed (as might be checked by laying one figure on top of the other). The connections shown have at most one line between elements which minimizes the space required between elements for given line width and tolerances, or alternately, permits greater line widths and tolerances. Similar connection arrangements are also possible for larger arrays. Table 5 below shows the resulting association between ROM bits and element locations.

TABLE 5

| ROM Bits at LCD Elements |
|---|
| 17 37 36 43 23 |
| 16 35 41 42 22 |
| 15 34 46 40 21 |
| 14 33 31 44 20 |
| 13 32 30 45 24 |
| 12 11 10 26 25 |

Below a derivation is given of the day of the week as determined from the date, and the evaluation of whether or not a leap year exists for a given year. This derivation has facilitated implementation of the automatic determination of the day of the week in the microcontroller owing to limited memory and the preference for manipulating data on a byte or half byte basis.

Day of Week and Leap Year Evaluation

On power up the day of the week is evaluated based on the day, month, and year stored amongst the MSC RAM registers 156. The day of the week is stored as an integer in the range from zero to six, corresponding to Sunday through Saturday, respectively. This value is simply incremented each day at midnight, unless the value is six, when it is reset to zero.

The evaluation of the day of the week requires knowledge of the occurrence of leap years, past, present, and future. The complete leap year algorithm specifies that a leap year occurs when the year is evenly divisible by four except for centenary years not evenly divisible by 400. Thus, for instance, the year 1900 although divisible by four is not a leap year, while the year 2000 is. The above leap year algorithm is valid for dates as of Oct. 15, 1582, when the Gregorian calendar, which modified the reckoning of leap years and is in general use today, replaced the Julian calendar. In view of the leap year definition, it follows that the number of days after Jan. 1, 2000 (or if a negative number then the number of days before January 1, but not earlier than Oct. 15, 1582) may be calculated from $$\Delta D = 365(y-2000) + INT\left(\frac{y-2001}{4}\right) - INT\left(\frac{y-2001}{100}\right) + INT\left(\frac{y-2001}{400}\right) + D_{yr}, \quad (1)$$

where the date is given in terms of the year y and the day of the year, $D_{yr}$.

To obtain an expression for the day of the week it is convenient to represent the year in terms of integers a, b, c, that relate to leap year periodicities, and a remainder number of years d, that is $$y=400a+100b+4c+d \quad (2)$$

where the integers a, b, c, and d are given by $$a = INT\left(\frac{y}{400}\right) \quad (3a)$$

$$b = INT\left(\frac{y}{100}\right) MOD\ 4 \quad (3b)$$

-continued $$c = INT\left(\frac{y}{4}\right) MOD\ 25 \quad (3c)$$

$$d = y MOD\ 4 \quad (3d)$$

Substituting (2) in (1) yields $$\Delta D=-730485+146097a+36524b+1461c+365d-1+D_{yr}, \quad (4)$$

where l is unity if y is a leap year, and zero otherwise, l being given by $$l = -INT\left(\frac{d-1}{4}\right) + INT\left(\frac{4c+d-1}{100}\right) - INT\left(\frac{100b+4c+d-1}{400}\right) \quad (5a)$$

This expression may logically be stated as

If $d = 0$ and (5b)
$c \neq 0$, or
$c = 0$ and $b = 0$
Then $l = 1$ else it is 0.

The year is stored in BCD format, two digits per byte, and in two consecutive RAM locations. Let the byte representing the hundreds of years be given by $y_m$ (most significant), and the byte representing the units and tens of years be given by $y_l$ (least significant). Then $$y=100y_m+y_l \quad (6)$$

Substituting this expression in equations (3a–d) and simplifying they become $$a = INT\left(\frac{ym}{4}\right) \quad (7a)$$

$$b = y_m\ MOD\ 4 \quad (7b)$$

$$c = INT\left(\frac{y_l}{4}\right) \quad (7c)$$

$$d = y_l\ MOD\ 4 \quad (7d)$$

The operations for the two bytes are thus seen to be identical and hence may be performed by a common subroutine. Both a and b, and c and d are determined by subtracting four from the respective byte until a number less than four is obtained. Each subtraction is counted to obtain a or c with the resulting remainder becoming b or d, respectively.

Since a given day of the week repeats every seventh day, the day of the week may be determined from AD on a modulus 7 basis to within an additive constant (6), or $$D_{wk}=(\Delta D+6)\ \text{MOD}\ 7 \quad (8a)$$

Substituting for ΔD the right side of (4) and simplifying yields $$D_{wk}=[D_{yr}-2(b+c)+d+6-l]\text{MOD}\ 7 \quad (8b)$$

The day of the week is hence determined for years through 9999, which is the maximum year the clock may be set.

The day of the year $D_{yr}$ given the month m, day of month $d_m$, and leap year condition l may be determined by various means such as by table look up, or formula (One such reference is Astronomical Formulae for Calculators, fourth edition, by Jean Meeus, 1988, Willmann-Bell, Inc., pp 28–29.). The method used here simply adds the days in each preceding month to the day of the current month. The days in February are equal to 28 plus 1, which is unity for leap years and zero otherwise. A simple algorithm for the number of days in a month is $$\begin{aligned}&\text{If } m = 2 \text{ then}\\&\quad d_{m\,max}(m) = 28 + l\\&\text{Else}\\&\quad \text{let } m_x = m\\&\quad \text{If } m_x > 7 \text{ then increment } m_x\ (m_x = m_x + 1)\\&\quad \text{If } m_x \text{ is even then } d_{m\,max}(m) = 30 \text{ else it is } 31\end{aligned} \tag{9}$$

The day of the year is equal to the day of the month $d_m$ plus the sum of the days in any previous months, namely $$\begin{aligned}&\text{If } m = 1 \text{ then } D_{yr} = d_m\\&\text{Else } D_{yr} = d_n + \sum_{i=1}^{m-1} d_{m\,max}(i)\end{aligned} \tag{10}$$

The day of the year is stored as two BCD coded bytes. Let dye, (most significant) represent the byte for the hundreds of days while $d_{yri}$ represents the byte for the tens and units of days (least significant). Then $$D_{yr}=100d_{yrl}+d_{yrl} \tag{11}$$

Making this substitution in equation (8b) gives $$D_{wk}=[2(d_{yrm}-b-c)+d_{yrl}+d+6-l]\text{MOD } 7 \tag{12}$$

The MOD 7 operation uses the same routine that is used to obtain the a, b, c, and d coefficients except that a divisor of seven is specified instead of four. Since the sum $d_{yrm}$–b–c can be negative and the MOD routine is given only for positive numbers this sum if negative is rendered positive by the addition of seven the necessary number of times. The multiplication of this sum by two is performed by simple addition, that is by adding this sum to itself. Also, on summing $d_{yrl}$ overflow condition can occur. This is remedied by using its MOD 7 value instead in the summation. These statements do not invalidate the above equation but are, however, details that permit a single byte implementation for this equation.

Ramifications

The display sequence given for the sequential character calendar clock is only one of numerous possibilities. Names of special holidays could be displayed or additional chronological data might also be included, such as the year, phase of the moon, sunrise (in which case geological coordinates are a consideration), sunset, etc.

The character set may be in languages other than English. The data could also be displayed in character form including Roman numerals. Alternately, a digit could be represented by a corresponding number of on display elements.

Input port I 160 has three unused inputs that could receive environmental data such as temperature, barometric pressure, wind velocity, etc. This data can be supplied in the form of a frequency modulated signal, such as provided by a voltage controlled oscillator. For example, the voltage output of a temperature transducer could modulate the frequency of a voltage controlled oscillator. An oscillator frequency range from 100 to 300 hz for a corresponding temperature range from −50 to +150 degrees Fahrenheit yields a convenient conversion factor of one hertz per degree. This frequency could be monitored during the one second blanking interval as most of this interval is spent in a wait loop until a timer underflow occurs.

To display additional information an increase in microcontroller memory will most likely be required. A companion microcontroller, a COP840 manufactured by National Semiconductor, should prove adequate. It has twice the memory in both ROM and RAM, and operates with substantially the same power.

The matrix display described consists of elements aligned in a rectangular array of rows and columns. Other matrix arrays are of course possible, most common being the seven segment display used primarily for displaying digits. Sixteen segment displays are also available and can display reasonably well numerals and upper case alphabetic characters. These displays have sixteen frontplane lines and one backplane line. The microcontroller has eighteen outputs, and thus could directly provide all drive signals.

Variations in the menu display of the clock are possible. Symbols for reasons of their international recognition features can replace characters to select main menu functions, for instance. The SCM menu when first displayed could be preceded by an automatic display of the data for the selected function if that data is not normally displayed. Additional menus could be used to select sub-categories of functions. For instance, DST dates are represented by two selections (S and F) in the main menu. Instead a single symbol could represent DST date selections. Another menu would then be displayed for setting beginning and ending DST dates.

The selection of R for entry to normal operation could be bypassed by an automatic return to normal operation after an interval time-out when no selection is made. However, the elimination of this selection would preclude setting the clock to approximate one second accuracy, at least as has been described in the preferred embodiment.

Many of the clock features are directly applicable to conventional multidigit clocks, and as well to other electrical appliances requiring a timekeeping function, such as VCR's and home heating-cooling thermostats. Such features include the digital speed adjustment, the implementation of the full four hundred leap year algorithm, the automatic correction for DST hour changes, and the user ability to modify DST Sundays. Automatically DST hour corrections in VCR, s should particularly be appreciated where wrong programs are recorded owing to DST hour changes.

There appears to be an apparent lack of commercial multiplex LCD drivers having an operating supply voltage range of at least 2.5 to 3.2 V, an operating supply current less than five microamperes, and a capability of driving a number of display elements. The approach described in the preferred embodiment is of course adaptable to a varying number of elements, and may be preferably consolidated into a single integrated circuit.

Also applicable to other appliances is the use of user friendly menus for setting or viewing purposes, and the use of a single switch for setting, and without special manipulation of the switch, such as by double clicking. The menu need not be limited to a single character or symbol but may consist of a number of characters, such as ALARM, for instance. The selectable functions can be displayed at about a one-third to one hertz rate using a common display area, with a selection being made upon their display by actuation of a switch, as described for the preferred embodiment. The function description and data can be displayed simultaneous in separate display areas, or they can be displayed serially using a common display area. Assuming a multidigit number is displayed at once, the most significant digit can be first indicated for change by displaying a menu of digits at the given digit position, with a selection being made upon a digit's display. After a selection is made the next most significant digit is automatically indicated for change by displaying another menu of digits at its digit position, this process continuing until all positions have been changed. Upon change of the last digit a version of the SCM menu can be displayed (an S selection would not be required if all digits are visible), so that the data might be again set, or the main menu is again displayed.

While the above descriptions contain many specificities they should not be construed as limiting the scope of this invention but rather to exemplify the embodiments of this invention. Accordingly, the scope of the invention should be determined by the appended claims and their legal equivalents.

What is claimed is:

1. An electrical apparatus comprising:

an electrooptical display;

digital timekeeping circuit means for maintaining horological information;

user input means for setting said apparatus; and display circuit means coupled to said digital timekeeping circuit means and having outputs coupled to said electrooptical display for displaying timekeeping information, said display circuit means including a setting means for displaying menus having a plurality of items that are sequentially indicated and selectable by said user input means, wherein said menus comprise first and second items, said first items facilitating selection of said second items, said second items modifying said digital timekeeping circuit means, wherein said setting means enables the automatic sequential indication of items of at least one menu having a plurality of said first items, wherein said second items are automatically sequentially indicated upon said display, wherein said user input means is in a first state when said timekeeping information is normally displayed, wherein said user input means is manually transferrable to a second state and an item being indicated is selected whereupon sequential indication ceases, and wherein said user input means is manually transferrable from said second state to said first state and said sequential indication resumes, whereby horological and other quantities are readily set.

2. The apparatus of claim 1 wherein said user input means comprises a manually operated switch, and wherein said at least one menu items are selectable by operation of said switch.

3. The apparatus of claim 2 wherein an item of said at least one menu is selected and said switch is maintained in said second state, and wherein said at least one menu item remains indicated while said switch is maintained in said second state, whereby a user visual confirmation is given of said selected item.

4. The apparatus of claim 3 wherein said at least one menu items are sequentially indicated at a rate greater than one item per three seconds.

5. The apparatus of claim 1 wherein said at least one menu items are displayed without a selection being made, and wherein said setting means includes an automatic repeat of said automatic sequential indication.

6. The apparatus of claim 5 wherein one of said items of said at least one menu enables normal timekeeping operation.

7. The apparatus of claim 1 wherein a menu of said first items contains an item enabling the display of a previously selected menu.

8. The apparatus of claim 7 wherein an item of said menu of said first items enables a user to view a value, whereby undisplayed values may be viewed.

9. The apparatus of claim 1 wherein said first items are indicated by their display one-at-a-time.

10. The apparatus of claim 9 wherein said first items are displayed at a common display area, whereby their number is not limited by display size.

11. The apparatus of claim 1 wherein a menu of said second items has a range of values for individual digits of multidigit numbers, and wherein said setting means further includes means for limiting the range of said values to meaningful numbers and for setting said digits in order from most to least significant until all said digits have been set, whereby multidigit numbers are readily set.

12. An electrical apparatus comprising:

an electrooptical display;

user manual input means for setting timekeeping information; and digital electronic circuit means having outputs coupled to said electrooptical display for displaying time related information, said digital electronic circuit means being responsive to said user manual input means, said time related information including a first menu, a plurality of second menus, and a third menu, each having a plurality of items that are sequentially and individually indicated upon said display in a predetermined order and are selectable by said user manual input means upon their indication, said first menu having items that are categories of timekeeping quantities to be set, said second menus having items that are alphanumeric values associated with said first menu items and are automatically sequentially indicated, said third menu having an item enabling a display of a subsequent menu, and wherein said third menu occurs in response to selection of an item of said first menu.

13. The apparatus of claim 12 whereto said subsequent menu is said first menu, whereby additional said timekeeping quantities are readily set.

14. The apparatus of claim 12 wherein said third menu includes an item enabling a display of one of said timekeeping quantities to be set, whereby undisplayed quantities are displayed.

15. The apparatus of claim 12 wherein said undisplayed quantities are displayed at a common display area, whereby said common display area is efficiently utilized.

16. The apparatus of claim 12 wherein immediately following a display of one of said second menus said third menu is displayed.

17. The apparatus of claim 12 wherein said first menu items are automatically sequentially indicated.

18. The apparatus of claim 17 wherein said third menu items are automatically sequentially indicated.

19. The apparatus of claim 18 wherein said manual input means consists of a single manually operated switch.

* * * * *